US012781133B2

(12) United States Patent
Narayanan et al.

(10) Patent No.: US 12,781,133 B2
(45) Date of Patent: Nov. 3, 2026

(54) METHODS FOR REDUCING FOULING IN TAR UPGRADING PROCESSES

(71) Applicant: ExxonMobil Chemical Patents Inc., Baytown, TX (US)

(72) Inventors: Sundar Narayanan, Annandale, NJ (US); Gaurav Agrawal, Branchburg, NJ (US); Teng Xu, Houston, TX (US)

(73) Assignee: ExxonMobil Chemical Patents Inc., Spring, TX (US)

( * ) Notice: Subject to any disclaimer, the term of this patent is extended or adjusted under 35 U.S.C. 154(b) by 34 days.

(21) Appl. No.: 18/690,673

(22) PCT Filed: Oct. 3, 2022

(86) PCT No.: PCT/US2022/077463
§ 371 (c)(1),
(2) Date: Mar. 8, 2024

(87) PCT Pub. No.: WO2023/060038
PCT Pub. Date: Apr. 13, 2023

(65) Prior Publication Data

US 2024/0384181 A1 Nov. 21, 2024

Related U.S. Application Data

(60) Provisional application No. 63/253,371, filed on Oct. 7, 2021.

(51) Int. Cl.

| | |
|---|---|
| ***C10G 9/16*** | (2006.01) |
| ***C10G 49/00*** | (2006.01) |
| ***C10G 69/06*** | (2006.01) |

(52) U.S. Cl.
CPC ..... *C10G 9/16* (2013.01); *C10G 49/005* (2013.01); *C10G 69/06* (2013.01);
(Continued)

(58) Field of Classification Search
CPC ..... C10G 9/16; C10G 49/005; C10G 69/06; C10G 2300/1059; C10G 2300/107;
(Continued)

(56) References Cited

U.S. PATENT DOCUMENTS

2018/0057759 A1 3/2018 Kandel et al.
2019/0367822 A1* 12/2019 Kandel ..... C10G 9/36
(Continued)

FOREIGN PATENT DOCUMENTS

| | | |
|---|---|---|
| CN | 110072980 A | 7/2019 |
| CN | 112585246 A | 3/2021 |
| CN | 112888765 A | 6/2021 |

OTHER PUBLICATIONS

Office Action received for Chinese Patent Application No. 202280066887.7, mailed on Feb. 27, 2026, 19 pages (10 pages of English Translation and 9 pages of Original Office Action).
(Continued)

*Primary Examiner* — Prem C Singh
*Assistant Examiner* — Juan C Valencia
(74) *Attorney, Agent, or Firm* — Shook Hardy & Bacon L.L.P.

(57) ABSTRACT

The present disclosure generally relates to methods for reducing fouling in tar upgrading processes and to apparatus for carrying out such processes. In some embodiments, a method is provided that includes providing a first tar stream, combining the first tar stream with a utility fluid to form a first process stream having a viscosity lower than that of the first tar stream, and heating the first process stream in a pre-heater under liquid phase conditions without feeding molecular hydrogen gas into the pre-heater to form a second process stream exiting the pre-heater.

19 Claims, 5 Drawing Sheets

(52) U.S. Cl.
CPC ..... *C10G 2300/1059* (2013.01); *C10G 2300/107* (2013.01); *C10G 2300/30* (2013.01); *C10G 2300/301* (2013.01); *C10G 2300/4006* (2013.01); *C10G 2300/4012* (2013.01); *C10G 2300/4081* (2013.01); *C10G 2300/708* (2013.01); *C10G 2300/802* (2013.01)

(58) Field of Classification Search
CPC ..... C10G 2300/30; C10G 2300/301; C10G 2300/4006; C10G 2300/4012; C10G 2300/4081; C10G 2300/708; C10G 2300/802; C10G 9/36; C10G 31/06
See application file for complete search history.

(56) References Cited

U.S. PATENT DOCUMENTS

| | | | | |
|---|---|---|---|---|
| 2020/0063047 | A1* | 2/2020 | Emanuele | C10G 65/04 |
| 2020/0071626 | A1 | 3/2020 | Kandel et al. | |
| 2021/0230490 | A1 | 7/2021 | Xu et al. | |
| 2021/0348064 | A1* | 11/2021 | Kandel | C10G 75/04 |

OTHER PUBLICATIONS

Search Report and Written Opinion received for Singaporean Patent Application No. 11202401577W, mailed on May 7, 2026, 6 pages.
Office Action received for Chinese Patent Application No. 202280066887.7, mailed on Jul. 22, 2026, 15 pages (6 pages of English Translation and 9 pages of Original Office Action).
Office Action received from Saudi Arabia Patent Application No. 1120241814, mailed on Jun. 27, 2026, 9 pages (4 pages English Translation and 5 pages Original Document).

* cited by examiner

METHODS FOR REDUCING FOULING IN TAR UPGRADING PROCESSES

CROSS-REFERENCE TO RELATED APPLICATIONS

This application is a US national phase application of PCT Application Serial No. PCT/US2022/077463 having a filing date of Oct. 3, 2022, which claims priority to and the benefit of U.S. Provisional Application No. 63/253,371 having a filing date of Oct. 7, 2021, the disclosures of both of which are incorporated herein by reference in their entireties.

FIELD

The present disclosure generally relates to methods for reducing fouling in tar upgrading processes and to apparatus for carrying out such processes.

BACKGROUND

The quantity and quality of by-product tar impacts the economics of olefin production from crude-fed steam crackers. Typically, tar is upgraded to useful products by heating at a high temperature during hydroprocessing. Prior to hydroprocessing in a hydroprocessing reactor, the tar feed is passed through heat-exchange equipment in the presence of $H_2$ to raise the temperature of the tar feed to a level suitable for hydroprocessing, e.g., an inlet temperature of the hydroprocessing reactor. However, such heating in the presence of $H_2$ promotes the deposition of foulants, residues, and other undesired materials on the walls of the heat-exchange equipment as well as other elements and apparatus used for tar upgrading.

There is a need for methods to reduce fouling in tar upgrading processes and for apparatus for carrying out such processes.

SUMMARY

The present disclosure generally relates to methods for reducing fouling in tar upgrading processes and to apparatus for carrying out such processes.

A first aspect of this disclosure relates to a method that includes (I) providing a first tar stream; (II) combining the first tar stream with a utility fluid to form a first process stream having a viscosity lower than that of the first tar stream; and (III) heating the first process stream in a pre-heater under liquid phase conditions without feeding molecular hydrogen gas into the pre-heater to form a second process stream exiting the pre-heater.

A second aspect of this disclosure relates to a method that includes (i) providing a first tar stream; (ii) heat soaking the first tar stream in a heat-soaking vessel to obtain a heat-soaked tar stream exiting the heat-soaking vessel; (iii) combining the heat-soaked tar stream with a utility fluid to form a first process stream having a viscosity lower than that of the heat-soaked tar stream; (iv) feeding the first process stream and optionally molecular hydrogen gas into a pre-heater; and (v) heating the first process stream in a pre-heater optionally in the presence of the molecular hydrogen gas to form a second process stream exiting the pre-heater.

A third aspect of this disclosure relates to an apparatus that includes a pre-heater having a first end and a second end, the pre-heater configured to heat a tar stream in the absence of added molecular hydrogen gas; and a first conduit coupled to the first end of the pre-heater, the first conduit configured for flowing the tar stream therethrough. The apparatus further includes a hydroprocessing reactor having a first end coupled to the second end of the pre-heater; a fractionator having a first end coupled to a second end of the hydroprocessing reactor, the fractionator configured to separate a mid-cut solvent from a stream being fractionated; and a second conduit coupled to a second end of the fractionator, the second conduit configured for flowing the mid-cut solvent therethrough, the second conduit coupled to the first conduit.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, for the disclosure may admit to other equally effective embodiments.

DETAILED DESCRIPTION

Figure 1:
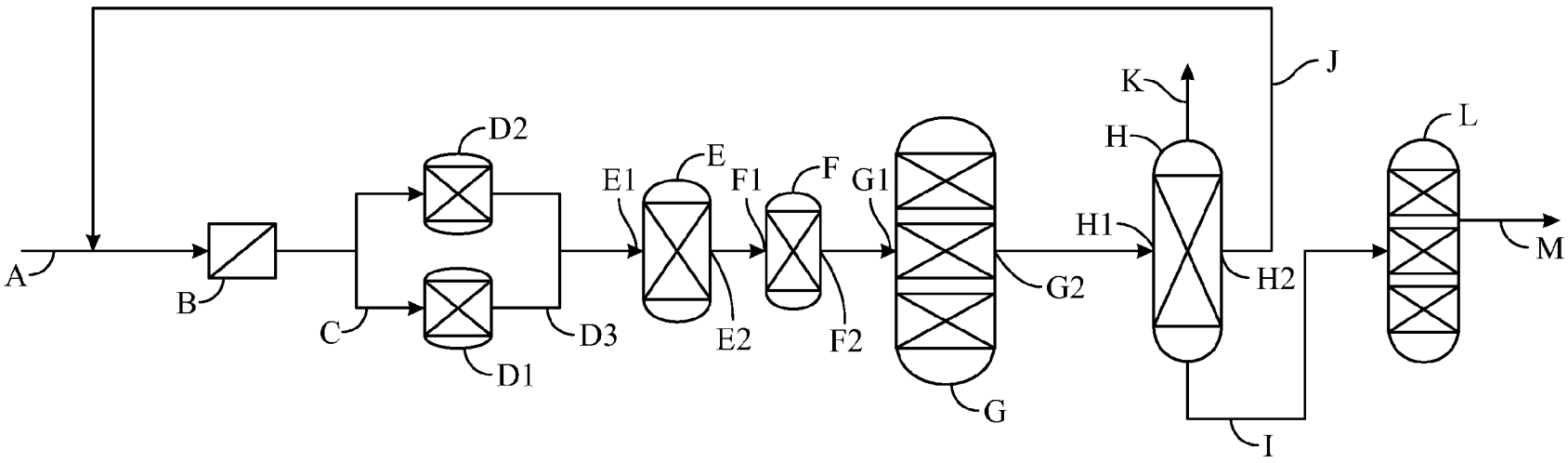
FIG. 1 schematically shows a process flow diagram of an example tar processing method according to at least one embodiment of the present disclosure.

It has been found, in a surprising manner, that fouling during tar upgrading can be prevented, or at least mitigated, during a pre-heating operation or pre-heating stage prior to entering a hydroprocessing reactor. In one aspect, the tar stream, fluxed or de-fluxed, can be preferentially pre-heated in the absence of added molecular hydrogen, contrary to conventional wisdom. In another aspect, the tar stream can be first heat soaked, and then preheated in the presence or in the absence of added molecular hydrogen. The tar feed can include, e.g., a by-product tar from crude cracking processes, though other tar feeds are contemplated. Embodiments described herein can enable equipment in the tar upgrading process to have a run-length that is estimated to be about 1 year or longer without fouling-related maintenance stoppage when, e.g., the tar feed is pre-heated either the liquid phase or the mixed phase as described herein. Longer or shorter durations are contemplated.

Conventionally, and during tar upgrading, the tar feed is heated in the presence of $H_2$ in heat-exchange equipment to a temperature that is about the inlet temperature of the hydroprocessing reactor. The conventional wisdom is that reactive species in the tar feed can be quenched by the $H_2$, thereby mitigating fouling of the heat transfer equipment utilized for pre-heating. However, it has been found that $H_2$ has little effect on mitigating fouling, and can, in fact, promote fouling. As described herein, when the tar stream has high reactivity and heat soaking is infeasible, the inventors show that pre-heating in the absence of $H_2$ gas, contrary to common wisdom, led to a longer time period before fouling related maintenance should be performed.

Liquid Phase Only (1st method): The inventors have found that heating the tar feed, with or without flux components, in liquid phase, can enable various equipment during tar upgrading to have a run-length of about 1 year or longer without fouling-related maintenance stoppage. Longer or shorter durations are contemplated. The liquid phase tar stream can be heat soaked.

Mixed phase: The inventors have further found that fouling can be reduced for mixed phase tar streams (e.g., tar streams with added molecular hydrogen gas) by pre-heating the tar stream prior to hydroprocessing as described herein. The mixed phase tar stream can be heat soaked prior to pre-heating.

When hydrogen is introduced into pre-heater and mixed with the tar stream, the tar stream is a so-called "mixed phase" tar stream. When the hydrogen is not introduced into pre-heater, the tar stream is a so-called "liquid phase" tar stream.

The term "flux" refers to a utility fluid having an ASTM D86 10% distillation point ≥60° C. and a 90% distillation point ≤425° C., wherein the utility fluid comprises of aromatic hydrocarbons.

The term "fluxed tar" refers to tar which has been diluted with flux specified above.

The term "defluxed tar" refers to tar prepared from a fluxed tar from which flux has been at least partially removed.

The term "unfluxed tar" refers to tar which has not been diluted by the addition of flux and which is fully heat soaked.

The term "pyrolysis tar" refers to (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥550° F. (290° C.). Certain pyrolysis tars have an initial boiling point ≥200° C. For certain pyrolysis tars, ≥90.0 wt % of the pyrolysis tar has a boiling point at atmospheric pressure ≥550° F. (290° C.). Pyrolysis tar can include, e.g., ≥50.0 wt %, e.g., ≥75.0 wt %, such as ≥90.0 wt %, based on the weight of the pyrolysis tar, of hydrocarbon molecules (including mixtures and aggregates thereof) having (i) one or more aromatic components and (ii) a number of carbon atoms ≥15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" refers to pyrolysis tar obtained from steam cracking.

Generally, tar is hydroprocessed in the presence of the specified utility fluid, e.g., as a mixture of tar and the specified utility fluid (a "tar-fluid" mixture). Although it is typical to determine reactivity ("$R_M$") of a tar-fluid mixture that includes a heat-soaked pyrolysis tar composition of reactivity $R_C$, it is within the scope of the present disclosure to determine reactivity of the pyrolysis tar ($R_T$ and/or $R_M$) itself. Utility fluids generally have a reactivity $R_U$ that is much less than pyrolysis tar reactivity. Accordingly, $R_C$ of a pyrolysis tar composition can be derived from $R_M$ of a tar-fluid mixture that includes the pyrolysis tar composition, and vice versa, using the relationship $$R_M \sim [R_C*(\text{weight of tar})+R_U*(\text{weight of utility fluid})]/(\text{weight of tar}+\text{weight of utility fluid})$$

For instance, if a utility fluid having $R_U$ of 3 bromine number (BN), and the utility fluid is 40% by weight of the tar-fluid mixture, and if $R_C$ (the reactivity of the neat pyrolysis tar composition) is 18 BN, then $R_M$ is approximately 12 BN.

"Tar Heavies" (TH) are a product of hydrocarbon pyrolysis having an atmospheric boiling point ≥565° C. and including ≥5.0 wt % of molecules having a plurality of aromatic cores based on the weight of the product. The TH can be solid at 25° C. and generally include the fraction of SCT that is not soluble in a 5:1 (vol:vol) ratio of n-pentane: SCT at 25° C. TH generally includes asphaltenes and other high molecular weight molecules.

Tar Upgrading Process Overview

Portions of an exemplary tar upgrading process that can be utilized with embodiments provided herein are described in, e.g., WO2018/111577, which is incorporated by reference herein in its entirety.

FIG. 1 shows an overview of selected portions of a tar upgrading process according to at least one embodiment of the present disclosure. A tar stream A to be processed can be optionally thermally treated (e.g., heat soaked) to reduce reactivity during transport to a centrifuge B. Centrifuge B is optional. A utility fluid J (which may act as a solvent for at least a portion of the tar's hydrocarbon compounds) may be added to the tar stream A to reduce viscosity. Utility fluid J may be recovered from the process for recycling. A filter (not shown) may be included in the transport line to remove relatively large insoluble solids. The tar stream is optionally centrifuged in centrifuge B to remove insoluble solids larger than, e.g., 25 μm. The tar stream can then be fed to a guard reactor, in the present illustration via a pretreatment manifold C, which directs the tar stream between an online guard reactor D1 and a guard reactor D2 that can be held offline, e.g., for maintenance. The guard reactor(s) D1 and/or D2 can be operated under mild hydroprocessing conditions to further reduce the tar reactivity. The effluent from the guard reactor passes through an outlet manifold D3 to a pre-heater E where the tar stream (in a liquid phase and/or a mixed phase) can be processed to reduce fouling.

In some embodiments, the pre-heated tar stream exiting pre-heater E is fed to a first stage hydroprocessing reactor, e.g., one or more of pretreatment hydroprocessing reactor F (also referred to as pretreater) and/or main hydroprocessing reactor G. In the pretreatment hydroprocessing reactor F, the tar stream is hydroprocessed in the presence of a catalyst. In the main hydroprocessing reactor G, the tar stream is hydroprocessed to obtain a total liquids product (TLP), also known as a total liquids stream, that is of blending quality, but can remain high in sulfur. Recovery facility H includes at least one separation, e.g., fractionation, for separating from the TLP (i) a light stream K suitable for fuels use, (ii) a heavy bottoms fraction stream/which includes heavier components of the TLP, and (iii) a mid-cut. At least a portion of the mid-cut can be recycled to the tar feed as utility fluid via line J. The bottoms fraction I is fed to a second stage hydroprocessing reactor L for an additional hydroprocessing step that performs, e.g., desulfurization. The effluent stream M from the second stage hydroprocessing reactor L can be low in sulfur content and can be suitable for blending into an Emission Control Area (ECA) compliant fuel.

In some embodiments, the pre-heater E has a first end E1 and a second end E2, the pre-heater configured to heat a tar stream in the absence of added molecular hydrogen gas or in the presence of added molecular hydrogen gas. The outlet manifold D3 (or conduit) is coupled to the first end of the pre-heater, the conduit configured for flowing the tar stream therethrough. The pretreatment hydroprocessing reactor F has a first end F1 coupled to the second end E2 of the pre-heater E. The process can, additionally or alternatively, include the main hydroprocessing reactor G. If the process additionally includes the main hydroprocessing reactor G, a second end F2 of the pretreatment hydroprocessing reactor F is coupled to a first end G1 of the main hydroprocessing reactor G. If the process includes the main hydroprocessing reactor G instead of the pretreatment hydroprocessing reactor F, the first end G1 of the main hydroprocessing reactor G is coupled to the second end E2 of the pre-heater E. The recovery facility H (e.g., a fractionator) has a first end H1 coupled to a second end F2 or G2 of the pretreatment hydroprocessing reactor F or the main hydroprocessing reactor G, respectively, the recovery facility H configured to separate a mid-cut solvent from a stream being fractionated. A conduit (e.g., line J) is coupled to a second end H2 of the recovery facility H (e.g., a fractionator), the conduit, or line J, configured for flowing the mid-cut solvent therethrough, the second conduit coupled to a line carrying the tar stream, such as line A or another line, e.g., one or more lines feeding to centrifuge B, manifold C, guard reactor(s) D1 and/or D2, and/or pre-heater E.

In some embodiments, a process for tar upgrading a liquid phase tar stream includes (I) providing a first tar stream; (II) combining the first tar stream with a utility fluid to form a first process stream having a viscosity lower than that of the first tar stream; and (III) heating the first process stream in a pre-heater under liquid phase conditions without feeding molecular hydrogen gas into the pre-heater to form a second process stream exiting the pre-heater. The process can further include (IV) feeding the second process stream into a hydroprocessing reactor; and (V) hydroprocessing the second process stream in the hydroprocessing reactor in the presence of a hydroprocessing catalyst under hydroprocessing conditions to produce a hydroprocessed effluent exiting the hydroprocessing reactor. These operations are further described below.

In some embodiments, a process for tar upgrading a liquid phase tar stream and/or a mixed phase tar stream includes (i) providing a first tar stream; (ii) heat soaking the first tar stream in a heat-soaking vessel to obtain a heat-soaked tar stream exiting the heat-soaking vessel; (iii) combining the heat-soaked tar stream with a utility fluid to form a first process stream having a viscosity lower than that of the heat-soaked tar stream; (iv) feeding the first process stream and optionally molecular hydrogen gas into a pre-heater; and (v) heating the first process stream in a pre-heater optionally in the presence of the molecular hydrogen gas to form a second process stream exiting the pre-heater. The process can further include (vi) feeding the second process stream into a hydroprocessing reactor; and (vii) hydroprocessing the second process stream in the hydroprocessing reactor in the presence of a hydroprocessing catalyst under hydroprocessing conditions to produce a hydroprocessed effluent exiting the hydroprocessing reactor. These operations are further described below.

In some embodiments, the tar stream can be a fluxed tar stream that includes a first fraction and a second fraction. The first fraction can be a tar fraction and the second fraction can be a steam cracker gas oil fraction. In at least one embodiment, before or after pre-heating the tar stream, at least a portion of the steam cracker gas oil fraction can be removed from the fluxed tar stream such that the resultant tar stream has a normal boiling point of at least 300° C., such as from 300° C. to 760° C.

Representative tars that can be used for embodiments described herein include, but are not limited to, a pyrolysis tar, a steam cracker tar (SCT), a heavy coker gas oil ("HCGO"), a vacuum tower fraction bottoms ("VTB"), a lube extract, a main column bottoms ("MCB") from fluid catalytic cracking ("FCC"), a steam cracker gas oil ("SCGO"), a quench oil, or combinations thereof. The quench oil extracted from the steam cracker process can be slightly heavier than a SCGO.

The reactivity of the tar stream, $R_T$, $R_C$, and $R_M$ can be expressed in bromine number units, i.e., the amount of bromine (as $Br_2$) in grams consumed (e.g., by reaction and/or sorption) by 100 grams of a pyrolysis tar sample. The reactivity of the tar stream can be measured using a sample withdrawn from a pyrolysis tar stream, e.g., bottoms of a flash drum separator, a tar storage tank, etc. The sample is combined with sufficient utility fluid to achieve a predetermined 50° C. kinematic viscosity in the tar-fluid mixture, such as ≤500 cSt. Although the bromine number measurement can be carried out with the tar-fluid mixture at an elevated temperature, it is typical to cool the tar-fluid mixture to a temperature of 25° C. before carrying out the bromine number measurement. Conventional methods for measuring bromine number of a heavy hydrocarbon can be used for determining pyrolysis tar reactivity, or that of a tar-fluid mixture, but the present disclosure is not limited thereto. For example, bromine number of a tar-fluid mixture can be determined by extrapolation from conventional bromine number methods as applied to light hydrocarbon streams, such as electrochemical titration, e.g., as specified in ASTM D1159.

The tar stream utilized for embodiments described herein can have a bromine number of at least 20, such as at least 25, such as at least 28, such as at least 30, such as at least 35, such as at least 40, such as at least 45. In at least one embodiment, the tar stream has a bromine number of no greater than 45, such as no greater than 40, such as no greater than 35, such as no greater than 30, such as no greater than 28, such as no greater than 25, such as no greater than 20.

Representative SCTs will now be described in more detail. The present disclosure is not limited to use of these SCTs, and this description is not intended to foreclose the processing of other pyrolysis tars within the broader scope of the present disclosure.

Steam Cracker Tar

Conventional separation equipment can be used for separating SCT and other products and by-products from the quenched steam cracking effluent, e.g., one or more flash drums, knock out drums, fractionators, water-quench towers, indirect condensers, etc. Suitable separation stages are described in U.S. Pat. No. 8,083,931, for example, incorporated by reference herein in its entirety. SCT can be obtained from the quenched effluent itself and or from one or more streams that have been separated from the quenched effluent. For example, SCT can be obtained from a steam cracker gas oil stream and/or a bottoms stream of the steam cracker's primary fractionator, from flash-drum bottoms (e.g., the bottoms of one or more tar knock out drums located downstream of the pyrolysis furnace and upstream of the primary fractionator), or a combination thereof. Some SCTs can be a mixture of primary fractionator bottoms and tar knock-out drum bottoms.

An example SCT stream from one or more of these sources can contain ≥90.0 wt % of SCT, based on the weight of the stream, e.g., ≥95.0 wt %, such as ≥99.0 wt %. More than 90 wt % of the remainder of the SCT stream's weight (e.g., the part of the stream that is not SCT, if any) can be particulates. The SCT can include ≥50.0 wt %, e.g., ≥75.0 wt %, such as ≥90.0 wt % of the quenched effluent's TH, based on the total weight TH in the quenched effluent.

The TH can be in the form of aggregates which include hydrogen and carbon and which have an average size in the range of 10.0 nm to 300.0 nm in at least one dimension and an average number of carbon atoms ≥50. Generally, the TH includes ≥50.0 wt %, e.g., ≥80.0wt %, such as >90.0 wt % of aggregates having a C: H atomic ratio in the range of from 1.0 to 1.8, a molecular weight in the range of 250 to 5000, and a melting point in the range of 100° C. to 700° C.

Representative SCTs can have (i) a TH content in the range of from 5.0 wt % to 40.0wt %, based on the weight of the SCT; (ii) an API gravity (measured at a temperature of 15.8° C.) of ≤8.5° API, such as ≤8.0° API, or <7.5° API; and/or (iii) a 50° C. viscosity in the range of 200 cSt to $1.0\times10^7$ cSt, e.g., $1\times10^3$ cSt to $1.0\times10^7$ cSt, as determined by ASTM D445. The SCT can have, e.g., a sulfur content that is ≥0.5 wt %, or ≥1 wt %, or more, e.g., in the range of 0.5 wt % to 7.0 wt %, based on the weight of the SCT. In embodiments, where the steam cracking feed does not contain an appreciable amount of sulfur, the SCT can comprise ≤0.5 wt % sulfur, e.g., ≤0.1 wt %, such as ≤0.05 wt % sulfur, based on the weight of the SCT.

The SCT can have, e.g., (i) a TH content in the range of from 5.0 wt % to 40.0 wt %, based on the weight of the SCT; (ii) a density at 15° C. in the range of 1.01 g/cm$^3$ to 1.19 g/cm$^3$, e.g., in the range of 1.07 g/cm$^3$ to 1.18 g/cm$^3$; and/or (iii) a 50° C. viscosity ≥200 cSt, e.g., ≥600 cSt, or in the range from 200 cSt to $1.0\times10^7$ cSt. The specified hydroprocessing can be advantageous for SCTs having a 15° C. density that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a 50° C. kinematic viscosity $\geq1.0\times10^4$ cSt, such as $\geq1.0\times10^5$ cSt, or $\geq1.0\times10^6$ cSt, or even $\geq1.0\times10^7$ cSt. Optionally, the SCT has the insolubility number, $I_N\geq80$ and ≥70 wt % of the pyrolysis tar's molecules have an atmospheric boiling point of ≥290° C. The SCT can have an insoluble content ("$IC_T$") ≥0.5 wt %, e.g., ≥1 wt %, such as ≥2 wt %, or ≥4 wt %, or ≥5 wt %, or ≥10 wt %.

Optionally, the SCT has a normal boiling point ≥290° C., a 15° C. kinematic viscosity $\geq1\times10^4$ cSt, and a density ≥1.1 g/cm$^3$. The SCT can be a mixture which includes a first SCT and one or more additional pyrolysis tars, e.g., a combination of the first SCT and one or more additional SCTs. When the SCT is, e.g., a mixture, at least 70 wt % of the mixture can have a normal boiling point of at least 290° C., and/or include olefinic hydrocarbon which contribute to the tar's reactivity under hydroprocessing conditions. When the mixture includes a first and second pyrolysis tars (one or more of which is optionally an SCT) ≥90 wt % of the second pyrolysis tar optionally has a normal boiling point ≥290° C.

One or more of these SCTs can be utilized with embodiments described herein.

Utility Fluids

Suitable utility fluids that can be utilized with embodiments described herein can include a mixture of multi-ring compounds. The rings can be aromatic or non-aromatic, and can contain a variety of substituents and/or heteroatoms. For example, a utility fluid can contain ring compounds in an amount ≥40.0 wt %, ≥45.0 wt %, ≥50.0 wt %, ≥55.0 wt %, or ≥60.0 wt %, based on the weight of the utility fluid. In some embodiments, at least a portion of a utility fluid is obtained from a hydroprocessor effluent, e.g., by one or more separations. This can be carried out as disclosed in U.S. Pat. No. 9,090,836, which is incorporated by reference herein in its entirety.

In some embodiments, a utility fluid includes aromatic hydrocarbons, e.g., ≥25.0 wt %, such as ≥40.0 wt %, or ≥50.0 wt %, or ≥55.0 wt %, or ≥60.0 wt % of aromatic hydrocarbon, based on the weight of the utility fluid. The aromatic hydrocarbon can include, e.g., one, two, and three ring aromatic hydrocarbon compounds. For example, the utility fluid can include ≥15 wt % of 2-ring and/or 3-ring aromatics, based on the weight of the utility fluid, such as ≥20 wt %, or ≥25.0 wt %, or ≥40.0 wt %, or ≥50.0 wt %, or ≥55.0 wt %, or ≥60.0 wt %. Utilizing a utility fluid comprising aromatic hydrocarbon compounds having 2-rings and/or 3-rings can be advantageous because utility fluids containing these compounds can exhibit an appreciable $S_{BN}$. Suitable utility fluids can have a significant solvency power, e.g., as indicated by an $S_{BN}\geq100$, e.g., ≥120, but the present disclosure is not limited to the use thereof. Such utility fluids can contain a major amount of 2 to 4 ring aromatics, with some being partially hydrogenated.

The utility fluid can have an ASTM D86 10% distillation point ≥60° C. and a 90% distillation point ≤425° C., e.g., ≤400° C. In some embodiments, the utility fluid has a true boiling point distribution with an initial boiling point ≥130° C. (266° F.) and a final boiling point ≤566° C. (1050° F.). In some embodiments, the utility fluid has a true boiling point distribution with an initial boiling point ≥150° C. (300° F.) and a final boiling point ≤430° C. (806° F.). In at least one embodiment, the utility fluid has a true boiling point distribution with an initial boiling point ≥177° C. (350° F.) and a final boiling point ≤425° C. (797° F.). True boiling point distributions (the distribution at atmospheric pressure) can be determined, e.g., by conventional methods such as the method of ASTM D7500. When the final boiling point is greater than that specified in the standard, the true boiling point distribution can be determined by extrapolation. A particular form of the utility fluid has a true boiling point distribution having an initial boiling point ≥130° C. and a final boiling point ≤566° C.; and/or includes ≥15 wt % of two ring and/or three ring aromatic compounds.

A tar-fluid mixture can be produced by combining a pyrolysis tar, e.g., SCT, with a sufficient amount of a utility fluid for the tar-fluid mixture to have a viscosity that is sufficiently low for the tar-fluid mixture to be conveyed to hydroprocessing, e.g., a 50° C. kinematic viscosity of the tar-fluid mixture that is <500 cSt. The amounts of utility fluid and pyrolysis tar in the tar-fluid mixture to achieve such a viscosity are generally in the range of from 20.0wt % to 95.0 wt % of the pyrolysis tar and from 5.0 wt % to 80.0 wt % of the utility fluid, based on total weight of tar-fluid mixture. For example, the relative amounts of utility fluid and pyrolysis tar in the tar-fluid mixture can be in the range of (i) 20.0 wt % to 90.0 wt % of the pyrolysis tar and 10.0 wt % to 80.0 wt % of the utility fluid, or (ii) from 40.0 wt % to 90.0 wt % of the pyrolysis tar and from 10.0 wt % to 60.0 wt % of the utility fluid. The weight ratio of utility fluid to pyrolysis tar can be ≥0.01, e.g., in the range of 0.05 to 4.0, such as in the range of 0.1 to 3.0, or 0.3 to 1.1. In some embodiments, such as when the pyrolysis tar includes a representative SCT, the tar-fluid mixture can include 50 wt % to 70 wt % of pyrolysis tar, with ≥90 wt % of the balance of the tar-fluid mixture including the specified utility fluid, e.g., ≥95 wt %, such as ≥99 wt %.

In at least one embodiment, a utility fluid is added to a tar stream before, during, and/or after pre-heating. In some embodiments, and when the tar stream is heat soaked and/or centrifuged prior to pre-heating, a utility fluid is added to that tar stream before, during, and/or after the optional heat soaking and/or the optional centrifugation operation.

In some embodiments, a utility fluid is combined with the tar being processed in the pre-heater before a heat soaking process operation that reduces the reactivity of the tar. (See, e.g. FIGS. 2 and 3, line 56 ("optional flux" inlet)). In some embodiments, the utility fluid is added to the tar after a heat soaking process step has been applied to the tar and before the process stream is fed into a solids-removal step. (This arrangement is not shown in the figures.)

The tar can be combined with a utility fluid to produce a tar-fluid mixture. Mixing of compositions that include hydrocarbons can result in precipitation of certain solids, for example asphaltenes, from the mixture. Hydrocarbon compositions that produce such precipitates upon mixing are said to be "incompatible." Creating an incompatible mixture can be avoided by mixing only compositions such that the solubility blending number, $S_{BN}$, of all of the components of the mixture is greater than the insolubility number, $I_N$, of all of the components of the mixture. Determining $S_{BN}$ and $I_N$ and so identifying compatible mixtures of hydrocarbon compositions is described in U.S. Pat. No. 5,997,723, incorporated by reference herein in its entirety.

Figure 2:
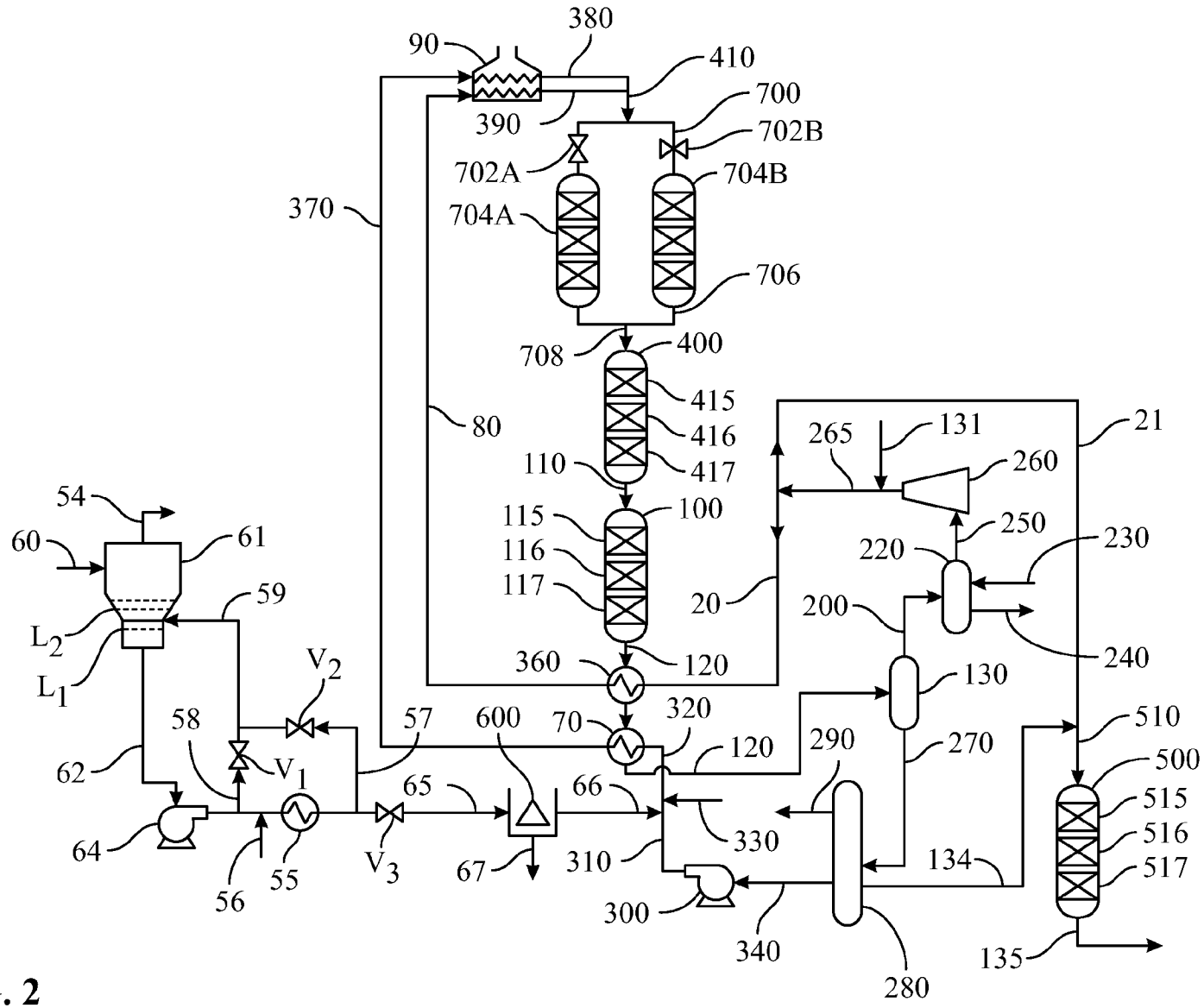
FIG. 2 schematically shows a more detailed schematic of portions of the example tar processing method shown in FIG. 1 according at least one embodiment of the present disclosure.
Figure 3:
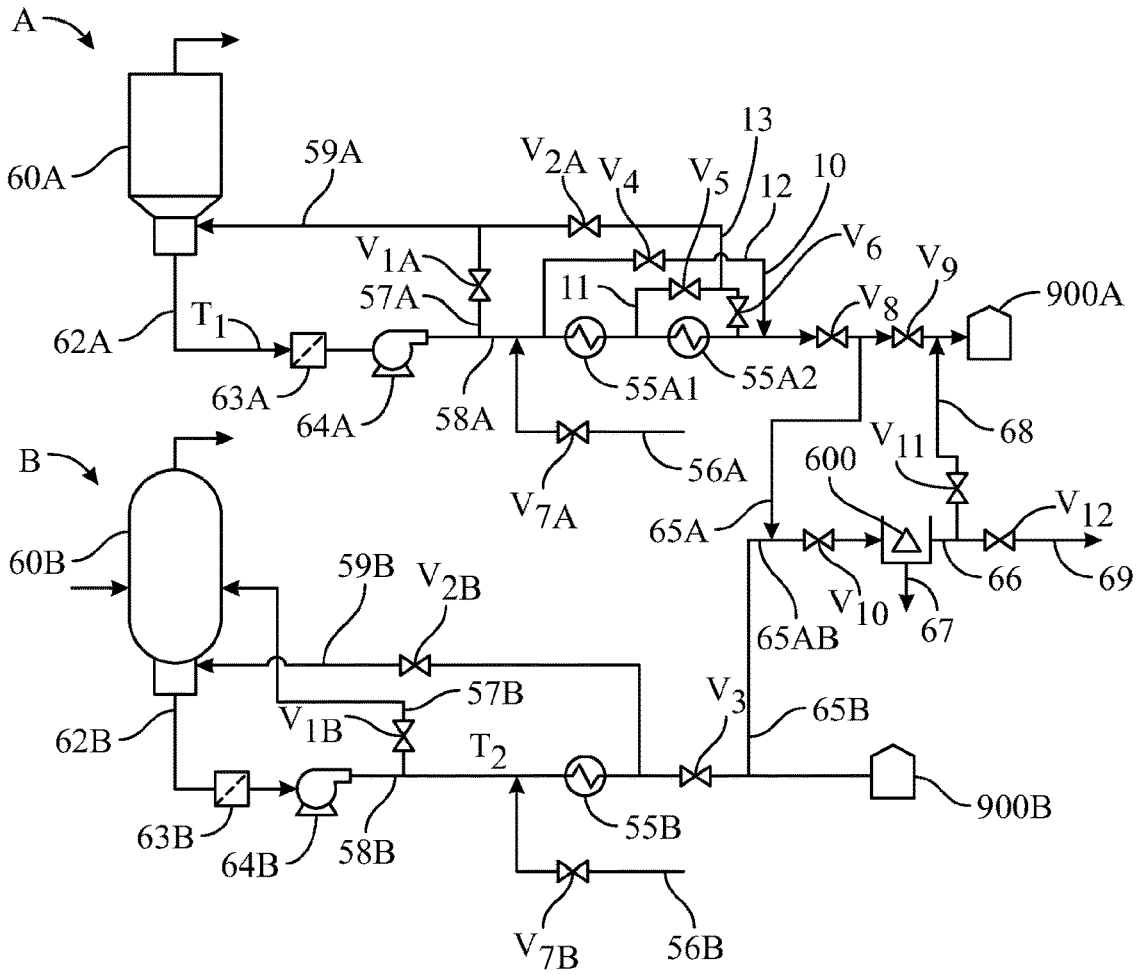
FIG. 3 schematically shows a schematic of example heat soaking processes according to at least one embodiment of the present disclosure.

Referring now to FIGS. 1-3, the process flow of the tar upgrading process is described in more detail.

The tar upgrading process can include operations of hydroprocessing, such that a later operation of hydroprocessing is conducted under similar or more severe conditions than an earlier operation of hydroprocessing. Thus, at least one stage of hydroprocessing under "Pretreatment Hydroprocessing Conditions", to lower the reactivity of the tar or of the tar-utility fluid mixture. The pretreatment hydroprocessing is carried out before a stage of hydroprocessing that is carried out under Intermediate Hydroprocessing Conditions. The intermediate hydroprocessing typically effects the major part of hydrogenation and some desulfurizing reactions. Pretreatment Hydroprocessing Conditions are less severe than "Intermediate Hydroprocessing Conditions". For example, compared to Intermediate Hydroprocessing Conditions, Pretreatment Hydroprocessing Conditions utilize one or more of a lesser hydroprocessing temperature, a lesser hydroprocessing pressure, a greater feed (tar+utility fluid) weight hourly space velocity (WHSV), a greater pyrolysis tar WHSV, and a lesser molecular hydrogen consumption rate "Intermediate Hydroprocessing Conditions" can include a temperature ("$T_I$")≥200° C.; a total pressure ("$P_I$")≥3.5 MPa, e.g., ≥6 MPa; and/or a weight hourly space velocity ("$WHSV_I$")≥0.3 $h^{-1}$, based on the weight the pretreated tar-fluid mixture subjected to the intermediate hydroprocessing; and a total amount of molecular hydrogen supplied to a hydroprocessing stage operating under Intermediate Hydroprocessing Conditions ≥1000 standard cubic feet per barrel of pretreated tar-fluid mixture subjected to intermediate hydroprocessing (178 S $m^3/m^3$). Conditions can be selected within the Intermediate Hydroprocessing Conditions to achieve a 566° C.+ conversion, of ≥20 wt % substantially continuously for at least ten days at a molecular hydrogen consumption rate in the range of from 2200 standard cubic feet per barrel of tar in the pretreater effluent (scfb) (392 S $m^3/m^3$) to 3200 scfb (570 S $m^3/m^3$).

In some embodiments, at least one stage of pretreatment hydroprocessing under "Pretreatment Hydroprocessing Conditions" is carried out before a stage of hydroprocessing under Intermediate Hydroprocessing Conditions. Pretreatment Hydroprocessing Conditions can include a temperature $T_{PT}$≤400° C., a space velocity ($WHSV_{PT}$)≥0.3 $h^{-1}$ based on the weight of the tar-fluid mixture, a total pressure ("$P_{PT}$") ≥3.5 MPa, e.g., ≥6 MPa, and/or supplying the molecular hydrogen at a rate <3000 standard cubic feet per barrel of the tar-fluid mixture (scfb) (534 S $m^3/m^3$).

Pretreatment Hydroprocessing Conditions can be less severe than Intermediate Hydroprocessing Conditions. For example, compared to Intermediate Hydroprocessing Conditions, Pretreatment Hydroprocessing Conditions utilize one or more of a lesser hydroprocessing temperature, a lesser hydroprocessing pressure, a greater feed (tar+utility fluid) WHSV, a greater pyrolysis tar WHSV, and/or a lesser molecular hydrogen consumption rate. Within the parameter ranges (T, P, WHSV, etc.) specified for Pretreater Hydroprocessing Conditions, hydroprocessing conditions can be selected to achieve a desired 566° C.+ conversion, e.g., in the range of 0.5 wt % to 5 wt % substantially continuously for at least ten days. Although operating the pretreatment hydroprocessing at an appreciably greater total pressure than the intermediate hydroprocessing is within the scope of the present disclosure, this is not required.

Optionally, at least one stage of retreatment hydroprocessing under Retreatment Hydroprocessing Conditions can be carried out after a stage of hydroprocessing under Intermediate Hydroprocessing Conditions. In some embodiments, the retreatment hydroprocessing is carried out with little or no utility fluid. "Retreatment Hydroprocessing Conditions", which are typically more severe than the Intermediate Hydroprocessing Conditions, include a temperature ($T_R$)≥360° C.; a space velocity ($WHSV_R$)≤0.6 $h^{-1}$, based on the weight of hydroprocessed tar subjected to the retreatment; a molecular hydrogen supply rate ≥2500 standard cubic feet per barrel of hydroprocessed tar (scfb) (445 S $m^3/m^3$); a total pressure ("$P_R$")≥3.5 MPa, e.g., ≥6 MPa; and/or $WHSV_R$≤$WHSV_I$.

When a temperature is indicated for particular catalytic hydroprocessing conditions in a hydroprocessing zone, e.g., Pretreatment, Intermediate, and Retreatment Hydroprocessing Conditions, this refers to the average temperature of the hydroprocessing zone's catalyst bed (one half the difference between the bed's inlet and outlet temperatures). When the hydroprocessing reactor contains more than one hydroprocessing zone (e.g., as shown in FIG. 1) the hydroprocessing temperature is the average temperature in the hydroprocessing reactor (e.g., one half the difference between the temperature of the most upstream catalyst bed's inlet and the temperature of the most downstream catalyst bed's outlet temperature).

Total pressure in each of the hydroprocessing stages can be regulated to maintain a flow of pyrolysis tar, pyrolysis tar composition, pretreated tar, hydroprocessed tar, and retreated tar from one hydroprocessing stage to the next, e.g., with little or need for inter-stage pumping. Although it is within the scope of the present disclosure for any of the hydroprocessing stages to operate at an appreciably greater pressure than others, e.g., to increase hydrogenation of any thermally-cracked molecules, this is not required. The present disclosure can be carried out using a sequence of total pressure from stage-to-stage that is sufficient (i) to achieve the desired amount of tar hydroprocessing; (ii) to overcome any pressure drops across the stages; and/or (iii) to maintain tar flow to the process, from stage-to-stage within the process, and away from the process.

Some embodiments of the present disclosure include a method for upgrading tar that includes one or more of heat-soaking a tar stream to produce a heat-soaked tar (a tar composition or tar stream, e.g., a pyrolysis tar composition or a pyrolysis tar stream), combining the tar composition/stream with utility fluid to produce a tar-fluid mixture, and/or pre-heating the tar-fluid mixture under pre-heating conditions. For example, the method can include one or more of heat-soaking a SCT to produce a SCT composition, combining the SCT composition with a specified amount of a specified utility fluid to produce a tar-fluid mixture, and/or pre-heating the tar-fluid mixture to form a pre-heated tar-fluid mixture.

The method for upgrading tar can further include hydroprocessing the pre-heated tar-fluid mixture under Pretreatment Hydroprocessing Conditions to produce a pretreater effluent, and hydroprocessing at least part of the pretreater effluent under Intermediate Hydroprocessing Conditions to produce a hydroprocessor effluent comprising hydroprocessed tar. For example, the method can include one or more of hydroprocessing the pre-heated tar-fluid mixture in a pretreatment reactor under Pretreatment Hydroprocessing Conditions to produce a pretreater effluent and/or hydroprocessing at least a portion of the pretreater effluent under Intermediate Hydroprocessing.

A: Optional Thermal Treatment (e.g., Heat-Soaking Operation)

An optional thermal treatment operation (e.g., heat-soaking operation) can be performed on a tar stream before pre-heating so as to reduce the reactivity of the tar stream during further processing. Here, the tar stream is subjected to an initial, controlled heat-soaking operation to, e.g., oligomerize reactive olefins (such as vinyl naphthalenes and acenaphthalenes) in the tar stream and thereby decrease the reactivity of the tar during further processing. Such a heat-soaking operation can mitigate fouling in the pre-heater and other downstream apparatus in the tar upgrading process. Fouling in the pre-heater and other downstream apparatus is particularly problematic when hydrogen is introduced into the pre-heater and mixed with the tar stream.

Both the mixed phase tar stream and the liquid phase tar stream can be subject to a heat soaking operation if desired. Some embodiments of the heat-soaking operation are described below in more detail with respect to a representative pyrolysis tar. The present disclosure is not limited to these aspects, and this description is not meant to foreclose other heat-soaking operations within the broader scope of the present disclosure.

In some embodiments, processes described herein can include a heat soaking operation having at least one of the following features: (a) an absolute pressure in the heat-soaking vessel in a range from 500 psia to 2000 psia (3,450 kPa to 13,790 kPa), such as from 600 psia to 1500 psia, such as from 700 psia to 1400 psia, such as from 800 psia to 1300 psia, such as from 900 psia to 1200 psia, such as from 1000 psia to 1100 psia; (b) a temperature of the heat-soaked tar stream in a range from 220° C. to 350° C., such as from 250° C. to 325° C., such as from 275° C. to 300° C.; and/or (c) a residence time of the first tar stream in the heat-soaking vessel in a range from 10 minutes to 120 minutes, such as from 30 minutes to 100 minutes, such as from 50 minutes to 75 minutes.

In some instances, the utility fluid can be added to the tar stream to improve tar flow characteristics before, during, and/or after the heat-soaking operation. Excessive dilution with utility fluid can lead to much slower reduction in tar BN during the heat-soaking operation. In at least one embodiment, the amount of utility fluid utilized used for viscosity reduction during heat-soaking operations can be controlled to ≤10 wt % based on the combined weight of tar and utility fluid. In some embodiments, tar dilution with utility fluid (as a solvent or flux) can be minimized prior to and/or during heat soaking.

FIG. 2 includes an exemplary cold tar recycle system (e.g., elements upstream of the centrifuge 600). FIG. 3 shows an alternative arrangement of the cold tar recycle system in which tar streams from two separate upstream processes are recycled separately and then can be combined for solids removal and subsequent downstream processing.

For representative tars, e.g., representative pyrolysis tars, such as representative SCTs, it is observed that the specified heat-soaking operation carried out by cold tar recycle, can decrease one or more of $R_T$, $R_C$, or $R_M$. The heat-soaking operation can be carried out using a pyrolysis tar feed of reactivity $R_T$ to produce a pyrolysis tar composition/stream having a lesser reactivity $R_C$. Conventional heat-soaking operations are suitable for heat treating pyrolysis tar, including heat soaking, but the present disclosure is not limited thereto. Although reactivity can be improved by blending the pyrolysis tar with a second pyrolysis tar of lesser olefinic hydrocarbon For example, combining a heat-soaked SCT with the specified utility fluid in the specified relative amounts can produce a tar-fluid mixture having an $R_M \leq 18$ BN. If substantially the same SCT is combined with substantially the same utility fluid in substantially the same relative amounts without heat-soaking the tar, the tar-fluid mixture can have an $R_M$ in the range of from 19 BN to 50 BN. Though higher or lower bromine numbers are contemplated.

One representative, but non-limiting, pyrolysis tar is an SCT ("SCT1") having an $R_T \geq 28$ BN (on a tar basis), such as $R_T$ of 35 BN; a density at 15° C. that is ≥1.10 g/cm$^3$; a 50° C. kinematic viscosity in the range of $\geq 1.0 \times 10^4$ cSt; an $I_N \geq 80$; and/or ≥70 wt % of SCT1's hydrocarbon components have an atmospheric boiling point of ≥290° C. SCT1 can be obtained from any suitable SCT source, e.g., from the bottoms of a separator drum (such as a tar drum) located downstream of steam cracker effluent quenching. The heat-soaking operation can include maintaining SCT1 to a temperature in the range of from $T_1$ to $T_2$ for a time $\geq t_{HS}$. In some embodiments, $T_1$ is ≥150° C., e.g., ≥160° C., such as ≥170° C., or ≥180° C., or ≥190° C., or ≥200° C.; $T_2$ is ≤320° C., e.g., ≤310°, such as ≤300° C., or ≤290° C., and $T_2$ is $\geq T_1$. In at least one embodiment, $t_{HS}$ is ≥1 min, e.g., ≥10 min, such as ≥100 min, or in the range of from 1 min to 400 min. In some embodiments, when $T_2$ is ≤320° C., utilizing a $t_{HS}$ of ≥10 min, e.g., ≥50 min, such as ≥100 min can produce a treated tar having better properties than those treated for a lesser $t_{HS}$.

The heat-soaking operation can be controlled by regulating (i) the weight ratio of the recycled portion of the second stream to the withdrawn SCT stream and/or (ii) the weight ratio of the recycle portion of the first stream to the recycle portion of the second stream. Controlling one or both of these ratios has been found to be effective for maintaining and average temperature of the SCT in the lower region of the tar drum in the desired ranges of $T_1$ to $T_2$ for a treatment time $t_{HS}$≥1 minute. A greater SCT recycle rate can correspond to a greater SCT residence time at elevated temperature in the tar drum and associated piping, and/or can increase the height of the tar drum's liquid level (the height of liquid SCT in the lower region of the tar drum, e.g., proximate to the boot region). The ratio of the weight of the recycled portion of the second stream to the weight of the withdrawn SCT stream can be ≤0.5, e.g., ≤0.4, such as ≤0.3, or ≤0.2, or in the range of from 0.1 to 0.5. The weight ratio of the recycle portion of the first stream to the recycle portion of the second stream can be ≤5, e.g., ≤4, such as ≤3, or ≤2, or ≤1, or ≤0.9, or ≤0.8, or in the range of from 0.6 to 5. Although it is not required to maintain the average temperature of the SCT in the lower region of the tar drum at a substantially constant value ($T_{HS}$), it can be done so. $T_{HS}$ can be, e.g., in the range of from 150° C. to 320° C., such as 160° C. to 310° C., or ≥170° C. to 300° C. In at least one embodiment, the heat-soaking operation conditions include (i) $T_{HS}$ is at least 10° C. greater than $T_1$ and/or (ii) $T_{HS}$ is in the range of 150° C. to 320° C. For example, $T_{HS}$ and $t_{HS}$ ranges can include 180° C.≤$T_{HS}$≤320° C. and/or 5 minutes≤$t_{HS}$≤120 minutes; e.g., 200° C.≤$T_{HS}$≤280° C. and/or 5 minutes≤$t_{HS}$≤50 minutes. In some embodiments, wherein $T_{HS}$ is ≤320° C., utilizing a $t_{HS}$ of ≥10 min., e.g., ≥50 min, such as ≥100 min can produce a better treated tar over those produced at a lesser $t_{HS}$.

In some embodiments, the heat-soaking operation can be effective for decreasing the representative SCT's reactivity to achieve an $R_C$≤$R_T$−0.5 BN, e.g., $R_C$≤$R_T$−1 BN, such as $R_C$≤$R_T$−2 BN, or $R_C$≤$R_T$−4 BN, or $R_C$≤$R_T$−8 BN, or $R_C$≤$R_T$−10 BN. RM can be ≤18 BN, e.g., ≤17 BN, such as 12 BN≤$R_M$≤18 BN. It can also decreases the need for solids-removal before hydroprocessing. $IC_C$ can be about the same as or is not appreciably different than $IC_T$. In some embodiments, $IC_C$ does not exceed $IC_T$+3 wt %, e.g., $IC_C$≤$IC_T$+2 wt %, such as $IC_C$≤$IC_T$+1 wt %, or $IC_C$≤$IC_T$+0.1 wt %.

Although the heat-soaking operation of the tar stream (e.g., SCT or other tar streams described herein) can be carried in one or more tar drums and related piping, the present disclosure is not limited thereto. For example, when the heat-soaking operation is, or includes, heat soaking, the heat soaking can be carried out at least in part in one or more soaker drums and/or in vessels, conduits, and other equipment (e.g. fractionators, water-quench towers, indirect condensers) associated with, e.g., (i) separating the pyrolysis tar from the pyrolysis effluent and/or (ii) conveying the pyrolysis tar to hydroprocessing. The location of the heat-soaking operation is not critical. The heat-soaking operation can be carried out at any convenient location, e.g., after tar separation from the pyrolysis effluent and/or before hydroprocessing, such as downstream of a tar drum and/or upstream of mixing the heat-soaked tar with utility fluid. In some embodiments, the heat soaking operation can be carried out after mixing a tar stream with a utility fluid.

In some embodiments, the heat-soaking operation is carried out as illustrated schematically in FIG. 2. As shown, quenched effluent from a steam cracker furnace facility is conducted via line 60 to a tar knock out drum 61. Cracked gas is removed from the drum via line 54. SCT condenses in the lower region of the drum (the boot region as shown), and a withdrawn stream of SCT is conducted away from the drum via line 62 to pump 64. A filter (not shown in the figure) for removing large solids, e.g. ≥10,000 μm diameter, from the SCT stream may be included in the line 62. After pump 64, a first recycle stream (line 58) and a second recycle stream (line 57) are diverted from the withdrawn stream. The first and second recycle streams are combined as recycle to drum 61 via line 59. One or more heat exchangers 55 is provided for cooling the SCT in lines 57 (shown) and 65 (not shown) e.g., against water. Line 56 provides an optional flux of utility fluid if needed. Valves $V_1$, $V_2$, and $V_3$ regulate the amounts of the withdrawn stream that are directed to the first recycle stream, the second recycle stream, and a stream conducted to solids separation, represented here by centrifuge 600, via line 65. Lines 58, 59, and 62 can be insulated to maintain the temperature of the SCT within the desired temperature range for the heat-soaking operation. The heat soaking operation time $t_{HS}$ can be increased by increasing SCT flow through valves $V_1$ and $V_2$, which raises the SCT liquid level in drum 61 from an initial level, e.g., $L_1$, toward $L_2$.

The heat soaked SCT is conducted through valve $V_3$ and via line 65 toward a solids removal facility, here a centrifuge 600, and then the liquid fraction from the centrifuge is conveyed via line 66 to a hydroprocessing facility comprising at least one hydroprocessing reactor. Solids removed from the tar are conducted away from the centrifuge via line 67. In the embodiments illustrated in FIG. 2 using a representative SCT such as SCT1, the average temperature $T_{HS}$ of the SCT during heat soaking in the lower region of tar drum (below $L_2$) can be in the range of from 200° C. to 275° C., and heat exchanger 55 cools the recycle portion of the second stream to a temperature in the range of from 60° C. to 80° C. The time $t_{HS}$ can be, e.g., ≥10 min, such as in the range of from 10 min to 30 min, or 15 min to 25 min.

In continuous operation, the SCT conducted via line 65 can include ≥50 wt % of SCT available for processing in drum 61, such as SCT, e.g., ≥75 wt %, such as ≥90 wt %. In some embodiments, substantially all of the SCT available for hydroprocessing is combined with the specified amount of the specified utility fluid to produce a tar-fluid mixture which is conducted to hydroprocessing. Depending, e.g., on hydroprocessor capacity limitations, a portion of the SCT in line 65 or line 66 can be conducted away, such as for storage or further processing, including storage followed by hydroprocessing (not shown).

In addition to the indicated heat soaking operation, the pyrolysis tar is optionally treated to remove solids, such as those having a particle size ≥10,000 μm. Solids can be removed before and/or after the heat soaking operation. For example, the tar stream can be heat soaked and combined with utility fluid to form a tar-fluid mixture from which the solids are removed. Alternatively or in addition, solids can be removed before or after any hydroprocessing stage. Although it is not limited thereto, the present disclosure is compatible with conventional solid-removal technology such as that disclosed in U.S. Patent Application Publication No. 2015-0361354, which is incorporated by reference herein in its entirety. For example, solids can be removed from the tar-fluid mixture in a temperature in the range of from 80° C. to 100° C. using a centrifuge.

FIG. 3 shows an alternative arrangement in which tars from two separate pyrolysis processes can be heat soaked in separate recycling processes and then combined for solids removal. A first process A includes a separation in a tar knockout drum 60A. The lights are removed overhead of the drum, as shown, e.g., for further separation in at least one fractionator. A bottoms fraction comprising a pyrolysis tar is removed from tar knockout drum 60A via line 62A through a filter 63A for removal of large solids, e.g. ≥10,000 μm diameter, to pump 64A. After pump 64A, a first recycle stream (line 58A) and a second recycle stream 57A (which bypasses the heat exchangers in line 58A) are diverted from the withdrawn stream. The first recycle stream is passed through a heat exchanger 55A1 and optionally one or more further heat exchangers 55A2 before recombining with second recycle stream 57A via lines 12 and 13 as recycle to drum 61A via line 59A. Heat exchangers 55A2 can be bypassed via lines 11 and 13 and appropriate configuration of valves $V_5$ and $V_6$. Both of heat exchangers 55A1 and 55A2 can be bypassed and the heat-soaked tar stream can be conducted to downstream process steps via line 10 and appropriate configuration of valves $V_4$, $V_5$, and $V_6$. The heat-soaked tar from process A can be sent to downstream process steps via line 65A and/or to storage (in tank 900A) by appropriate configuration of valves $V_8$ and $V_9$. The proportion of recycle through the heat exchangers and bypassing them can be regulated by appropriate configuration of valves $V_{1A}$ and $V_{2A}$. Line 56A and valve $V_{7A}$ can be configured to provide an optional flux of utility fluid if desired. A second process B includes a pyrolysis operation that includes a separation by fractionation, e.g., in a primary fractionator 60B. The lights are removed overhead of the primary fractionator as shown, e.g., to a secondary fractionator. The bottoms of fractionator 60B comprising a pyrolysis tar, is removed from primary fractionator 60B via line 62B through a filter 63B for removal of large solids, e.g. ≥10,000 μm diameter, to pump 64B. After pump 64B, a first recycle stream (line 58B) and a second recycle stream of line 57B (which bypasses the heat exchangers in line 58B) are diverted from the withdrawn stream. The first recycle stream is passed through a heat exchanger 55B and optionally one or more further heat exchangers (not shown) before recycling to the bottoms collector of the fractionator 60B via line 59B through valve $V_{2B}$. The second recycle stream recycles via valve $V_{1B}$ to the fractionator. The proportion of recycle through the primary fractionator and through the fractionator bottoms collector is regulated by appropriate configuration of valves $V_{1B}$ and $V_{2B}$. Line 56B and valve $V_{7B}$ can be configured to provide an optional flux of utility fluid if needed. Valve $V_3$ controls the flow from the heat soaking process to the solids removal facility (here centrifuge 600), via line 65B and/or to storage (in tank 900B).

In the heat soaking operation of the tar produced in process A, a temperature $T_1$ is shown, and the temperature of the heat soaking operation of the tar produced in process B is shown as $T_2$. $T_1$ and $T_2$ can be the same or different, and are chosen appropriately for the particular tar to be heat soaked and the desired residence time for the heat soaking operation. For example, $T_1$ for a pyrolysis tar obtained from a tar knockout drum might be 250° C., and $T_2$, for a pyrolysis tar obtained from the bottoms of a primary fractionator, might be 280° C.

In FIG. 3, lines 58A, 58B, 59A, 59B, 62A, and 62B can be insulated to maintain the temperature of the SCT within the desired temperature range for the heat soaking operation.

Downstream of the joinder of lines 65A and 65B, valve $V_{10}$ regulates the amounts of the heat-soaked tar that is fed to a solids removal operation. Here, solids are removed by the centrifuge 600.

B: Optional Centrifugation

The tar stream can be optionally treated in centrifuge B to remove solids, such as those having a particle size ≥25 μm, such as ≥100 μm, such as ≥1,000 μm, such as ≥10,000 μm. Larger or smaller particle sizes are contemplated. Solids can be removed before and/or after pre-heating in the pre-heater E. When a heat soaking operation is utilized, solids can be removed before and/or after heat soaking. For example, the tar stream can be combined with utility fluid to form a tar-fluid mixture from which the solids are removed. Alternatively or in addition, solids can be removed before or after any hydroprocessing stage. Although it is not limited thereto, the present disclosure is compatible with use of conventional solid-removal technology such as that disclosed in U.S. Patent Application Publication No. 2015/0361354, which is incorporated by reference herein in its entirety.

In some embodiments, centrifugation (which can be assisted by using the utility fluid) is used for solids removal. For example, solids can be removed from the tar-fluid mixture at a temperature in the range of from 80° C. to 100° C. using a centrifuge. Any suitable centrifuge may be used, including those industrial-scale centrifuges available from Alfa Laval. The feed to the centrifuge may be a tar-fluid mixture that includes utility fluid and a tar composition/stream (heat-soaked tar). The amount of utility fluid can be controlled such that the density of tar-fluid mixture at the centrifugation temperature, e.g., 50° C. to 120° C., or from 60° C. to 100° C., or from 60° C. to 90° C., is substantially the same as the desired feed density (1.02 g/ml to 1.06 to g/ml at 80° C. to 90° C.).

The utility fluid comprises, consists essentially of, or even consists of a mid-cut stream separated from a product of tar hydroprocessing. For example, all or a part of the mid-cut stream can be obtained from the downstream utility fluid recovery step of the presently disclosed process. The amount of utility fluid in the tar-fluid mixture can be around 40 wt % for a wide variety of pyrolysis tars, but can vary, for example from 20 wt % to 60 wt %, so as to provide the feed at a desired density, which may be pre-selected.

Continuing with FIG. 2, the heat-soaked tar stream is conducted via line 65 through valve $V_3$ into a centrifuge 600. The liquid product is conducted via line 66 storage and/or the specified hydroprocessing. At least a portion of solids removed during centrifuging are conducted away via line 67, e.g., for storage or further processing.

Similarly in FIG. 3, the heat-soaked tar stream from process A via line 65A and the heat-soaked tar stream from process B via line 65B are combined in line 65AB and conducted to the centrifuge 600 via valve $V_{10}$. The liquid product is conducted via lines 66 and 69 to downstream hydroprocessing facilities. The solid product is removed via line 67, which can be conducted away. Line 68 conveys the centrifuge liquid product to storage. Allocation of the centrifuge liquid product to storage or to further downstream processing is controlled by configuration of valves $V_{11}$ and $V_{12}$.

The centrifuge can operate at 2000×g to 6000×g at a temperature in the range of from 50° C. to 125° C., or from 70° C. to 110° C., or from 70° C. to 100° C. or from 70° C. to 95° C., where "g" is acceleration due to gravity. A higher centrifugation temperature can allow for cleaner separation of solids from the tar. When the feed to the centrifuge contains 20-50 wt % solids, the centrifugation can be performed at a temperature in the range of from 80° C. to 100° C. and/or a force of 2000×g to 6000×g.

The centrifuge is effective in removing particulates from the feed, such as those of size ≥25 μm. The amount of particles ≥25 μm in the centrifuge effluent can be less than 2 vol % of all the particles. Tar, e.g., pyrolysis tar, such as SCT, can contain a relatively large concentration of particles having a size ≤25 μm. For representative tars, the amount of solids generally ranges from 100 ppm to 170 ppm with a median concentration of ~150 ppm. Particles having a size of ≤25 μm appear to be carried through the instant process without significant fouling.

Following the removal of solids, the tar stream is subject to additional processes to further lower the reactivity of the tar before hydroprocessing under Intermediate Hydroprocessing Conditions. These additional processes are collectively called "pretreatment" and include pretreatment hydroprocessing in a guard reactor and then further additional hydroprocessing in an intermediate hydroprocessing reactor.

D: Optional Pretreatment in a Guard Reactor

An optional pretreatment can be used to decrease tar reactivity and decrease fouling by any particulates in centrifuge effluent to lessen pretreater fouling. Here, a guard reactor (e.g., 704A, 704B in FIG. 2; D1 and/or D2 in FIG. 1) can be used to protect downstream reactors from fouling from reactive olefins and solids. In some configurations (illustrated in FIGS. 1 and 2), two guard reactors are run in alternating mode—one on-line with the other off-line. When one of the guard reactors exhibits an undesirable increase in pressure drop, it is brought off-line so that it can be serviced and restored to condition for continued guard reactor operation. Restoration while off-line can be carried out, e.g., by replacing reactor packing and replacing or regenerating the reactor's internals, including catalyst. A plurality of (online) guard reactors can be used. Although the guard reactors can be arranged serially, at least two guard reactors can be arranged in parallel, as shown in FIGS. 2 and 3.

Referring again to FIG. 2, an optionally heat-soaked tar stream having solids ≥25 μm substantially removed is conducted via line 66 for optional processing in at least one guard reactor. This composition is combined with recovered utility fluid supplied via conduit 310 to produce the tar-fluid mixture in line 320. Optionally, a supplemental utility fluid, may be added via conduit 330. A first pre-heater 70 pre-heats the tar-fluid mixture (which can be in liquid phase or mixed phase), and the pre-heated mixture is conducted to a supplemental pre-heating stage 90 via conduit 370. Supplemental pre-heater stage 90 can be, e.g., a fired heater. Recycled treat gas is obtained from line 265 and, if necessary, is mixed with fresh treat gas, supplied through conduit 131. The treat gas is conducted via conduit 20 through a third pre-heater 360, before being conducted to the supplemental pre-heat stage 90 via conduit 80. Fouling in the main hydroprocessing reactor 100 can be decreased by increasing feed pre-heater duty in first pre-heater 70 and 90. Operation of the first pre-heater 70 and/or second pre-heater 90 are described below.

Continuing with reference to FIG. 2, the pre-heated tar-fluid mixture (from line 380) is combined with the pre-heated treat gas (from line 390) and then conducted via line 410 to guard reactor inlet manifold 700. Mixing means (not shown) can be utilized for combining the pre-heated tar-fluid mixture with the pre-heated treat gas in guard reactor inlet manifold 700. The guard reactor inlet manifold directs the combined tar-fluid mixture and treat gas to online guard reactors, e.g. 704A, via an appropriate configuration of guard reactor inlet valves 702A, shown open, and 702B shown closed. An offline guard reactor 704B is illustrated, which can be isolated from the pretreatment inlet manifold by the closed valve 702B and a second isolation valve (not shown) downstream of the outlet of the offline guard reactor 704B. On-line reactor 704A can also be brought off-line, and isolated from the process, when the offline guard reactor 704B is brought online. Reactors 704A and 704B can be brought off-line in sequence (one after the other) so that one of 704A or 704B is on-line while the other is off-line, e.g., for regeneration. Effluent from the online guard reactor(s) is conducted to further downstream processes via a guard reactor outlet manifold 706 and line 708. The guard reactor outlet manifold 706 and the line 708 can be represented by line D3 in FIG. 1. Numeral 110 is the inlet line of the main hydroprocessing reactor 100.

A configuration of an illustrative, but non-limiting, guard reactor is described in WO 2018/111577. The guard reactor can be operated under guard reactor hydroprocessing conditions. Such conditions can include a temperature in the range of 200° C. to 300° C., such as such as from 200° C. to 280° C., such as from 250° C. to 280° C., such as from 250° C. to 270° C., such as from 260° C. to 300° C.; a total pressure in the range of 1000 psia to 2000 psia, such as from 1300 psia to 1500 psia; and/or a WHSV in the range from 5 $h^{-1}$ to 7 $h^{-1}$. The guard reactor can include a catalytically-effective amount of at least one hydroprocessing catalyst. Upstream beds of the reactor include at least one catalyst having de-metallization activity, e.g., relatively large-pore catalysts to capture metals in the feed. Beds located further downstream in the reactor can contain at least one catalyst having activity for olefin saturation, e.g., catalyst containing Ni and/or Mo. The guard reactor can receive as feed a tar-fluid mixture having a reactivity $R_M$≤18 BN on a feed basis, where the tar component of the tar-fluid mixture has an $R_T$ and/or $R_C$≤30 BN, and such as ≤28 BN, on a tar basis.

E: Pre-Heating Operation to Reduce Fouling

The tar stream with or without an added fluid, e.g., a utility fluid, SCGO, quench oil, etc., enters the pre-heater E. In the pre-heater, this tar stream with or without the added fluid can be heated under liquid phase conditions without feeding molecular hydrogen gas into the pre-heater to form a process stream exiting the pre-heater. In some embodiments, the tar stream with or without the added fluid can be heated under mixed phase conditions (e.g., in the presence of molecular hydrogen gas that is fed to the pre-heater) to form a process stream exiting the pre-heater Conditions for the pre-heater can include one or more of the following features: (a) an absolute pressure in the pre-heater in a range from 500 psia to 2000 psia (3,450 kPa to 13,790 kPa), such as from 600 psia to 1500 psia, such as from 700 psia to 1400 psia, such as from 800 psia to 1300 psia, such as from 900 psia to 1200 psia, such as from 1000 psia to 1100 psia; (b) a temperature of the second process stream in a range from 300° C. to 450° C., such as from 325° C. to 425° C., such as from 350° C. to 400° C.; and/or (c) a residence time of the first process stream in the pre-heater in a range from 10 seconds to 350 seconds, such as from 20seconds to 150 seconds, such as from 30 to 70 seconds.

Molecular hydrogen gas can be added to the pre-heater E during pre-heating of the tar stream. In such embodiments, molecular hydrogen gas can be fed into the pre-heater a at a feeding rate in a range from 1 to 2000 (such as 10 to 400, such as 50 to 300) standard cubic feet of molecular hydrogen gas per 42 US gallons of the tar stream being heated (e.g., the heat-soaked tar stream).

In some embodiments, the pre-heater is operable for at least 10 days before fouling related maintenance is performed. For example, the number of days that the pre-heater is operable before a 0.25 inch foulant layer is formed can be 10 days or more, such as 20 days or more, such as 50 days or more, such as 100 days or more, such as 125 days or more, such as 150 days or more, such as 175 days or more, such as 200 days or more, as determined by metallograph measurement. The amount of foulant can be measured in one or more locations of the pre-heater, such as two locations.

F: Pretreatment Hydroprocessing in a Pretreatment Hydroprocessing Reactor

As discussed above, and after pre-heating the tar stream in a pre-heater in order to, e.g., reduce fouling, the pre-heated tar stream can be flowed into a hydroprocessing reactor (e.g., pretreater F and/or main hydroprocessing reactor G of FIG. 1).

Certain forms of the pretreatment hydroprocessing reactor will now be described with continued reference to FIG. 2. In some embodiments, the tar-fluid mixture is hydroprocessed under the specified Pretreatment Hydroprocessing Conditions described below to produce a pretreatment hydroprocessor (pretreater) effluent. The present disclosure is not limited to these embodiments, and this description is not meant to foreclose other embodiments within the broader scope of the present disclosure.

The tar stream exiting the pre-heater can be hydroprocessed in the presence of molecular hydrogen under Pretreatment Hydroprocessing Conditions to produce a pretreatment hydroprocessing reactor effluent. The pretreatment hydroprocessing can be carried out in at least one hydroprocessing zone located in at least one pretreatment hydroprocessing reactor. The pretreatment hydroprocessing reactor can be in the form of a conventional hydroprocessing reactor, but the present disclosure is not limited thereto.

Pretreatment Hydroprocessing Conditions include temperature $T_{PT}$, total pressure $P_{PT}$, and space velocity $WHSV_{PT}$. One or more of these parameters can be different from those of the intermediate hydroprocessing ($T_I$, $P_I$, and $WHSV_I$). Pretreatment Hydroprocessing Conditions can include one or more of $T_{PT} \geq 150°$ C., e.g., ≥200° C. but less than $T_I$ (e.g., $T_{PT} \leq T_I - 10°$ C., such as $T_{PT} \leq T_I - 25°$ C., such as $T_{PT} \leq T_I - 50°$ C.); a total pressure $P_{PT}$ that is ≥8 MPa but less than $P_I$; a $WHSV_{PT} \geq 0.3\ h^{-1}$ and greater than $WHSV_I$ (e.g., $WHSV_{PT} \geq WHSV_I + 0.01\ h^{-1}$, such as $\geq WHSV_I + 0.05\ h^{-1}$, or $\geq WHSV_I + 0.1\ h^{-1}$, or $\geq WHSV_I + 0.5\ h^{-1}$, or $\geq WHSV_I + 1\ h^{-1}$, or $\geq WHSV_I + 10\ h^{-1}$, or more), and/or a molecular hydrogen consumption rate that in the range of from 150 standard cubic meters of molecular hydrogen per cubic meter of the pyrolysis tar (S $m^3/m^3$) to 400 S $m^3/m^3$ (845 scfb to 2250 scfb) but less than that of intermediate hydroprocessing. The Pretreatment Hydroprocessing Conditions can include $T_{PT}$ in the range of 260° C. to 300° C.; a $WHSV_{PT}$ in the range of 1.5 $h^{-1}$ to 3.5 $h^{-1}$, e.g., 2 $h^{-1}$ to 3 $h^{-1}$; a $P_{PT}$ in the range of 6 MPa to 13.1 MPa; a molecular hydrogen supply rate in a range of 600 standard cubic feet per barrel of tar-fluid mixture (scfb) (107 S $m^3/m^3$) to 1000 scfb (178 S $m^3/m^3$), and/or a molecular hydrogen consumption rate in the range of 300 standard cubic feet per barrel of the pyrolysis tar composition in the tar-fluid mixture (scfb) (53 S $m^3/m^3$) to 400 scfb (71 S $m^3/m^3$). Using the specified Pretreatment Hydroprocessing Conditions results in an appreciably longer hydroprocessing duration without significant reactor fouling (e.g., as evidenced by no significant increase in hydroprocessing reactor pressure drop) than is the case when hydroprocessing a substantially similar tar-fluid mixture under more severe conditions, e.g., under Intermediate Hydroprocessing Conditions (described further below). The duration of pretreatment hydroprocessing without significantly fouling can be at least 10 times longer than would be the case if more severe hydroprocessing conditions were used, e.g., ≥100 times longer, such as ≥1000 times longer. Although the pretreatment hydroprocessing can be carried out within one pretreatment hydroprocessing reactor, it is within the scope of the present disclosure to use two or more reactors. For example, first and second pretreatment reactors can be used, where the first pretreatment hydroprocessing reactor operates at a lower temperature and greater space velocity within the Pretreatment Hydroprocessing Conditions than the second pretreatment hydroprocessing reactor Pretreatment hydroprocessing can be carried out in the presence of hydrogen, e.g., by (i) combining molecular hydrogen with the tar-fluid mixture upstream of the pretreatment hydroprocessing, and/or (ii) conducting molecular hydrogen to the pretreatment hydroprocessing reactor in one or more conduits or lines. Although relatively pure molecular hydrogen can be utilized for the hydroprocessing, it can be desirable to use a "treat gas" which contains sufficient molecular hydrogen for the pretreatment hydroprocessing and optionally other species (e.g., nitrogen and light hydrocarbons such as methane) which generally do not adversely interfere with or affect either the reactions or the products. The treat gas optionally contains ≥50 vol % of molecular hydrogen, e.g., ≥75 vol %, such as ≥90 vol %, based on the total volume of treat gas conducted to the pretreatment hydroprocessing stage.

The pretreatment hydroprocessing in at least one hydroprocessing zone of the pretreatment hydroprocessing reactor can be carried out in the presence of a catalytically-effective amount of at least one catalyst having activity for hydrocarbon hydroprocessing. Conventional hydroprocessing catalysts can be utilized for pretreatment hydroprocessing, such as those specified for use in resid and/or heavy oil hydroprocessing, but the present disclosure is not limited thereto. Suitable pretreatment hydroprocessing catalysts include bulk metallic catalysts and supported catalysts. The metals can be in elemental form or in the form of a compound. The catalyst can include at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Conventional catalysts, e.g., RT-621, can be used, but the present disclosure is not limited thereto.

In some embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can include a total amount of Group 5 to 10 metals in a range of from 0.0001 grams to 0.6 grams, or from 0.001grams to 0.3 grams, or from 0.005 grams to 0.1 grams, or from 0.01 grams to 0.08 grams. In at least one embodiment, the catalyst further includes at least one Group 15 element. An example of a Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

The tar-fluid mixture can be primarily in the liquid phase during the pretreatment hydroprocessing. For example, ≥75 wt % of the tar-fluid mixture can be in the liquid phase during the hydroprocessing, such ≥90 wt %, or ≥99 wt %. The pretreatment hydroprocessing produces a pretreater effluent which at the pretreatment reactor's outlet comprises (i) a primarily vapor-phase portion including unreacted treat gas, primarily vapor-phase products derived from the treat gas and the tar-fluid mixture, e.g., during the pretreatment hydroprocessing, and (ii) a primarily liquid-phase portion which includes pretreated tar-fluid mixture, unreacted utility fluid, and products, e.g., cracked products, of the pyrolysis tar and or utility fluid as may be produced during the pretreatment hydroprocessing. The liquid-phase portion (namely the pretreated tar-fluid mixture which comprises the pretreated pyrolysis tar) can further include insolubles and has a reactivity ($R_F$)≤12 BN, e.g., ≤11 BN, such as ≤10 BN.

Some embodiments of the pretreatment hydroprocessing will now be described in more detail with respect to FIG. 2. As shown in FIG. 2, guard reactor effluent flows from the guard reactor via line 708 to the pretreatment reactor 400. The guard reactor effluent can be mixed with additional treat gas (not shown); the additional treat gas can also be pre-heated. Mixing means (not shown) can be utilized for combining the guard reactor effluent with the pre-heated treat gas in pretreatment reactor 400, e.g., one or more gas-liquid distributors of the type conventionally utilized in fixed bed reactors.

The pretreatment hydroprocessing can be carried out in the presence of hydroprocessing catalyst(s) located in at least one catalyst bed 415. Additional catalyst beds, e.g., 416, 417, etc., may be connected in series with the at least one catalyst bed 415, optionally with intercooling using treat gas from conduit 20 being provided between beds (not shown). Pretreater effluent can be conducted away from pretreatment reactor 400 via line 110.

In some embodiments, the following Pretreatment Hydroprocessing Conditions can be used to achieve the target reactivity (in BN) in the pretreater effluent: $T_{PT}$ in the range of 250° C. to 325° C., or 275° C. to 325° C., or 260° C. to 300° C., or 280° C. to 300° C.; $WHSV_{PT}$ in the range of 2 $h^{-1}$ to 3 $h^{-1}$; $P_{PT}$ in the range of 1000 psia to 2000 psia, e.g., 1300 psia to 1500 psia;

and/or a treat gas rate in the range of 600 scfb to 1000 scfb, or 800 scfb to 900 scfb (on a feed basis). Under these conditions, the pretreater effluent's reactivity can be ≤12 BN.

G: Intermediate Hydroprocessing for Hydrogenating and Desulfurizing in a Main Hydroprocessing Reactor Referring again to FIG. 1, a main hydroprocessing reactor G can be utilized for carrying out desired tar-conversion reactions, including hydrogenating and first desulfurizing reactions. The main hydroprocessing reactor can add approximately 800 scfb to 2000 scfb, of molecular hydrogen to the feed, e.g., approximately 1000 scfb to 1500 scfb, most of which can be added to tar rather than to the utility fluid One or more sets of reactions can occur in the main hydroprocessing reactor.

A first set of reactions (a first tar conversion) can be the most important ones in reducing the size of tar molecules, particularly the size of TH. Doing so leads to a significant reduction in the tar's 1050° F.+ fraction. A second set of reactions (hydrodesulfurization or HDS), can desulfurize the tar. For SCT, few alkyl chains survive the steam cracking and most molecules are dealkylated. As a result, sulfur-containing molecules, e.g., benzothiophene or dibenzothiophenes, generally contain exposed sulfurs. These sulfur-containing molecules are readily removed using one or more conventional hydroprocessing catalysts, but the present disclosure is not limited thereto. Suitable conventional catalysts include those comprising one or more of Ni, Co, and Mo on a support, such as aluminate ($Al_2O_3$).

A third set of reactions (a second tar conversion) can be used, and these can include hydrogenation followed by ring opening to further reduce the size of tar molecules. A fourth set of reactions (aromatics saturation) can also be used. Adding hydrogen to the product of the first, second, and/or third reactions can improve the quality of the hydroprocessed tar.

In some embodiments, intermediate hydroprocessing of at least a portion the pretreated tar-fluid mixture is carried out in reactor G under Intermediate Hydroprocessing Conditions, e.g., to effect at least hydrogenation and desulfurization. This intermediate hydroprocessing will now be described in more detail.

In some embodiments, though not shown in FIG. 2, liquid and vapor portions can be separated from the pretreater effluent. The vapor portion can be upgraded to remove impurities such as sulfur compounds and light paraffinic hydrocarbon, and the upgraded vapor can be recycled as treat gas for use in one or more of hydroprocessing reactors 704, 400, 100, and 500. The separated liquid portion can be conducted to a hydroprocessing stage operating under Intermediate Hydroprocessing Conditions to produce a hydroprocessed tar. Additional processing of the liquid portion, e.g., solids removal, can be used upstream of the intermediate hydroprocessing.

In some embodiments, as shown in FIG. 2, the entire effluent of the pretreater is conducted away from pretreatment reactor 400 via line 110 for intermediate hydroprocessing of the entire pretreatment hydroprocessing effluent in a main hydroprocessing reactor 100 (Reactor G in FIG. 1). It will be appreciated by those skilled in the art, that for a wide range of conditions within the Pretreatment Hydroprocessing Conditions and for a wide range of tar-fluid mixtures, sufficient molecular hydrogen may remain in the pretreatment hydroprocessing effluent for the intermediate hydroprocessing of the pretreated tar-fluid mixture in main hydroprocessing reactor 100 without need for supplying additional treat gas, e.g., from the conduit 20.

The intermediate hydroprocessing in at least one hydroprocessing zone of the main hydroprocessing reactor can be carried out in the presence of a catalytically-effective amount of at least one catalyst having activity for hydrocarbon hydroprocessing. The catalyst can be selected from among the same catalysts specified for use in the pretreatment hydroprocessing. For example, the intermediate hydroprocessing can be carried out in the presence of a catalytically effective amount hydroprocessing catalyst(s) located in at least one catalyst bed 115. Additional catalyst beds, e.g., 116, 117, etc., may be connected in series with the at least one catalyst bed 115, optionally with intercooling using treat gas from line 60 being provided between beds (not shown). The intermediate hydroprocessed effluent is conducted away from the main hydroprocessing reactor 100 via line 120.

The intermediate hydroprocessing can be carried out in the presence of hydrogen, e.g., by one or more of (i) combining molecular hydrogen with the pretreatment effluent upstream of the intermediate hydroprocessing (not shown), (ii) conducting molecular hydrogen to the main hydroprocessing reactor in one or more conduits or lines (not shown), and/or (iii) utilizing molecular hydrogen (such as in the form of unreacted treat gas) in the pretreatment hydroprocessing effluent.

The Intermediate Hydroprocessing Conditions can include $T_I$>400° C., e.g., in the range of from 300° C. to 500° C., such as 350° C. to 430° C., or 350° C. to 420° C., or 360° C. to 420° C., or 360° C. to 410° C.; and a $WHSV_I$ in the range of from 0.3 $h^{-1}$ to 20 $h^{-1}$ or 0.3 $h^{-1}$ to 10 $h^{-1}$, based on the weight of the pretreated tar-fluid mixture subjected to the intermediate hydroprocessing. It is also typical for the Intermediate Hydroprocessing Conditions to include a molecular hydrogen partial pressure during the hydroprocessing ≥8 MPa, or ≥9 MPa, or ≥10 MPa, although in some embodiments it is ≤14 MPa, such as ≤13 MPa, or ≤12 MPa. For example, $P_I$ can be in the range of from 6 MPa to 13.1 MPa. Generally, $WHSV_I$ is ≥0.5 $h^{-1}$, such as ≥1.0 $h^{-1}$, or alternatively ≤5 $h^{-1}$, e.g., ≤4 $h^{-1}$, or ≤3 $h^{-1}$. The amount of molecular hydrogen supplied to a hydroprocessing stage operating under Intermediate Hydroprocessing Conditions can be in the range of from 1000 scfb (standard cubic feet per barrel) (178 S $m^3/m^3$) to 10000 scfb (1780 S $m^3/m^3$), in which B refers to barrel of pretreated tar-fluid mixture that is conducted to the intermediate hydroprocessing. For example, the molecular hydrogen can be provided in a range of from 3000 scfb (S34 S $m^3/m^3$) to 5000 scfb (890 S $m^3/m^3$). The amount of molecular hydrogen supplied to hydroprocess the pretreated pyrolysis tar component of the pretreated tar-fluid mixture can be less than would be the case if the pyrolysis tar component was not pretreated and contained greater amounts of olefin, e.g., such as vinyl aromatics. The molecular hydrogen consumption rate during Intermediate Hydroprocessing Conditions can be in the range of 350 standard cubic feet per barrel (scfb, which is 62 standard cubic meters/cubic meter (S $m^3/m^3$)) to 1500 scfb (267 S $m^3/m^3$), where the denominator represents barrels of the pretreated pyrolysis tar, in the range of 1000 scfb (178 S $m^3/m^3$) to 1500 scfb (267 S $m^3/m^3$), or 2200 scfb (392 S $m^3/m^3$) to 3200 scfb (570 S $m^3/m^3$).

Within the parameter ranges (T, P, WHSV, etc.) specified for Intermediate Hydroprocessing Conditions, particular hydroprocessing conditions for a particular pyrolysis tar can be selected to (i) achieve the desired 566° C.+ conversion, e.g., ≥20 wt % substantially continuously for at least ten days, and (ii) produce a TLP and hydroprocessed pyrolysis tar having the desired properties, e.g., the desired density and viscosity. The term 566° C.+ conversion means the conversion during hydroprocessing of pyrolysis tar compounds having boiling a normal boiling point ≥566° C. to compounds having boiling points <566° C. This 566° C.+ conversion includes a high rate of conversion of $T_{HS}$, resulting in a hydroprocessed pyrolysis tar having desirable properties.

Conditions for a significantly longer duration without significant reactor fouling (e.g., as evidenced by no significant increase in reactor dP during the desired duration of hydroprocessing, such as a pressure drop of ≤140 kPa during a hydroprocessing duration of 10 days, e.g., ≤70 kPa, or ≤35 kPa) than is the case under substantially the same hydroprocessing conditions for a tar-fluid mixture that has not been pretreated. The duration of hydroprocessing without significantly fouling can be at least 10 times longer than would be the case for a tar-fluid mixture that has not been pretreated, e.g., ≥100 times longer, such as ≥1000 times longer.

In some embodiments, Intermediate Hydroprocessing Conditions include a $T_I$ in the range of from 320° C. to 450° C., or 340° C. to 425° C., or 360° C. to 410° C., or 375° C. to 410° C.; $P_I$ in the range of from 1000 psi to 2000 psi, such as 1300 psi to 1500 psi; WHSV/in the range of from 0.5 to 1.2 $h^{-1}$, such as 0.7 $h^{-1}$ to 1.0 $h^{-1}$, or 0.6 $h^{-1}$ to 0.8 $h^{-1}$, or 0.7 $h^{-1}$ to 0.8 $h^{-1}$; and/or a treat gas rate in the range of from 2000 scfb to 6000 scfb, or 2500 scfb to 5500 scfb, or 3000scfb to 5000 scfb (feed basis). Feed to the main reactor can have a reactivity ≤12 BN. The weight ratio of tar: utility fluid in the feed to the main reactor can be in the range of from 50to 80:50 to 20, such as 60:40. The intermediate hydroprocessing (hydrogenating and desulfurizing) can add from 1000 scfb to 2000 scfb of molecular hydrogen (feed basis) to the tar, and can reduce the sulfur content of the tar by ≥80 wt %, e.g. ≥95 wt %, or in the range of from 80 wt % to 90 wt %.

H: Recovering the Intermediate Hydroprocessed Pyrolysis Tar

Referring again to FIG. 2, the hydroprocessor effluent is conducted away from the main hydroprocessing reactor 100 via line 120. When the second and first pre-heater 70 and the second pre-heater 360 are heat exchangers, the hot hydroprocessor effluent in line 120 can be used to pre-heat the tar/utility fluid and the treat gas respectively by indirect heat transfer. Following this optional heat exchange, the hydroprocessor effluent is conducted to separation stage 130 for separating total vapor product (e.g., heteroatom vapor, vapor-phase cracked products, unused treat gas, etc.) and TLP from the hydroprocessor effluent. The total vapor product is conducted via line 200 to upgrading stage 220, which can include, e.g., one or more amine towers. Fresh amine is conducted to upgrading stage 220 via line 230, with rich amine conducted away via line 240. Regenerated treat gas is conducted away from upgrading stage 220 via line 250, compressed in compressor 260, and conducted via line 265, conduit 20, and line 21 for recycle and re-use in the main hydroprocessing reactor 100 and optionally in the second hydroprocessing reactor 500.

The TLP from separation stage 130 can include hydroprocessed pyrolysis tar, e.g., ≥10 wt % of hydroprocessed pyrolysis tar, such as ≥50 wt %, or ≥75 wt %, or ≥90 wt %. The TLP optionally contains non-tar components, e.g., a hydrocarbon having a true boiling point range that is substantially the same as that of the utility fluid (e.g., unreacted utility fluid). The TLP can be useful as a diluent (e.g., a flux) for heavy hydrocarbons, such as those of relatively high viscosity. Optionally, all or a portion of the TLP can substitute for more expensive, conventional diluents. Non-limiting examples of blendstocks suitable for blending with the TLP and/or hydroprocessed tar include one or more of bunker fuel; burner oil; heavy fuel oil, e.g., No. 5 and No. 6 fuel oil; high-sulfur fuel oil; low-sulfur fuel oil; regular-sulfur fuel oil (RSFO); gas oil as may be obtained from the distillation of crude oil, crude oil components, and hydrocarbon derived from crude oil (e.g., coker gas oil), and the like. For example, the TLP can be used as a blending component to produce a fuel oil composition that includes ≤0.5 wt % sulfur. Although the TLP is an improved product over the tar feed, and is a useful blendstock "as-is", it can be beneficial to carry out further processing.

In embodiments illustrated in FIG. 2, TLP from separation stage 130 is conducted via line 270 to a further separation stage 280, e.g., for separating from the TLP one or more of hydroprocessed pyrolysis tar, additional vapor, and at last one stream suitable for use as recycle as utility fluid or a utility fluid component. Separation stage 280 may be, for example, a distillation column with side-stream draw although other conventional separation methods may be utilized. An overhead stream, a side stream and a bottoms stream, listed in order of increasing boiling point, are separated from the TLP in separation stage 280. The overhead stream (e.g., vapor) is conducted away from separation stage 280 via line 290. The bottoms stream conducted away via line 134 can include ≥50 wt % of hydroprocessed pyrolysis tar, e.g., ≥75 wt %, such as ≥90 wt %, ≥99 wt %.

At least a portion of the overhead and bottoms streams may be conducted away, e.g., for storage and/or for further processing. The bottoms stream of line 134 can be used as a diluent (e.g., a flux) for heavy hydrocarbon, e.g., heavy fuel oil. When desired, at least a portion of the overhead stream in the line 290 can be combined with at least a portion of the bottoms stream (line 134) for a further improvement in properties.

Optionally, separation stage 280 can be adjusted to shift the boiling point distribution of a side stream (exiting via conduit 340) so that the side stream has properties desired for the utility fluid, e.g., (i) a true boiling point distribution having an initial boiling point ≥177° C. (350° F.) and a final boiling point ≤566° C. (1050° F.) and/or (ii) an $S_{BN}$≥100, e.g., ≥120, such as ≥125, or ≥130.

Optionally, trim molecules may be separated, for example, in a fractionator (not shown), from separation stage 280 bottoms or overhead or both and added to the side stream exiting via conduit 340, as desired. The side stream (a mid-cut) can be conducted away from separation stage 280 via the conduit 340. At least a portion of the side stream traveling via conduit 340 can be utilized as utility fluid and conducted via pump 300 and conduit 310. The side stream composition of conduit 310 (the mid-cut stream) can be at least 10 wt % of the utility fluid, e.g., ≥25 wt %, such as ≥50 wt %, or higher.

The hydroprocessed pyrolysis tar product from the intermediate hydroprocessing has desirable properties, e.g., a 15° C. density measured that can be at least 0.10 g/cm$^3$ less than the density of the heat-soaked pyrolysis tar. For example, the hydroprocessed tar can have a density that is at least 0.12, or at least 0.14, or at least 0.15, or at least 0.17 g/cm$^3$ less than the density of the pyrolysis tar composition. The hydroprocessed tar's 50° C. kinematic viscosity can be ≤1000 cSt. For example, the viscosity can be ≤500 cSt, e.g., ≤150 cSt, such as ≤100 cSt, or ≤75 cSt, or ≤50 cSt, or ≤40 cSt, or ≤30 cSt. Generally, the intermediate hydroprocessing results in a significant viscosity improvement over the pyrolysis tar conducted to the heat soaking operation, the pyrolysis tar composition, and the pretreated pyrolysis tar. For example, when the 50° C. kinematic viscosity of the pyrolysis tar (e.g., obtained as feed from a tar knock-out drum) is ≥1.0×10$^4$ cSt, e.g., ≥1.0×10$^5$ cSt, ≥1.0×10$^6$ cSt, or ≥1.0×10$^7$ cSt, the 50° C. kinematic viscosity of the hydroprocessed tar can be ≤200 cSt, e.g., ≤150 cSt, preferably, ≤100 cSt, ≤75 cSt, ≤50 cSt, ≤40 cSt, or ≤30 cSt. Particularly when the pyrolysis tar feed to the specified heat soaking operation has a sulfur content ≥1 wt %, the hydroprocessed tar can have a sulfur content ≥0.5 wt %, e.g., in a range of 0.5 wt % to 0.8 wt %.

J: Utility Fluid Recovery

The utility fluid J (FIG. 1) can be obtained from a recycle stream. In some embodiments, 70 wt % to 85 wt % of the mid-cut stream from separation stage 280 (e.g., a fractionator) can be recycled as at least a portion of the utility fluid.

In some embodiments, the amount of recycled utility fluid in the tar-fluid mixture fed to the pre-heater can be 40 wt %, based on the weight of the tar-fluid mixture, but can range from 1 wt % to 50 wt %, such as from 10 wt % to 50 wt % or from 30 wt % to 45 wt %. Higher or lower amounts of utility fluid can be utilized.

L: Retreatment Reactor to Further Reduce Sulfur

When it is desired to further improve properties of the hydroprocessed tar, e.g., by removing at least a portion of any sulfur remaining in hydroprocessed tar, an upgraded tar can be produced by optional retreatment hydroprocessing. Certain forms of the retreatment hydroprocessing will now be described in more detail with respect to FIG. 2. The retreatment hydroprocessing is not limited to these forms, and this description is not meant to foreclose other forms of retreatment hydroprocessing within the broader scope of the present disclosure.

Referring again to FIG. 2, hydroprocessed tar (line 134) and treat gas (line 21) are conducted to retreatment reactor 500 via line 510. Retreatment reactor 500 can be smaller than main hydroprocessing reactor 100. Typically, the retreatment hydroprocessing in at least one hydroprocessing zone of the intermediate reactor is carried out in the presence of a catalytically-effective amount of at least one catalyst having activity for hydrocarbon hydroprocessing. For example, the retreatment hydroprocessing can be carried out in the presence hydroprocessing catalyst(s) located in at least one catalyst bed 515. Additional catalyst beds, e.g., 516, 517, etc., may be connected in series with the at least one catalyst bed 515, optionally with intercooling, e.g., using treat gas from conduit 20, being provided between beds (not shown). The catalyst can be selected from among the same catalysts specified for use in the pretreatment hydroprocessing. A retreater effluent comprising upgraded tar can be conducted away from the retreatment reactor 500 via line 135.

Although the retreatment hydroprocessing can be carried out in the presence of the utility fluid, it can be carried out with little or no utility fluid to avoid undesirable utility fluid hydrogenation and cracking under Retreatment Hydroprocessing Conditions, which can be more severe than the Intermediate Hydroprocessing Conditions. For example, (i) ≥50 wt % of liquid-phase hydrocarbon present during the retreatment hydroprocessing is hydroprocessed tar obtained from line 134, such as ≥75 wt %, or ≥90 wt %, or ≥99 wt %, and/or (ii) utility fluid comprises ≤50 wt % of the balance of the of liquid-phase hydrocarbon, e.g., ≤25 wt %, such as ≤10 wt %, or ≤1 wt %. In some embodiments, the liquid phase hydrocarbon present in the retreatment reactor is a hydroprocessed tar that is substantially free of utility fluid. Sulfur content of the feed to the (optional) retreatment reactor can be 0.5 wt % to 0.8 wt %, or perhaps from 0.3 to 0.8 wt %. Since this amount is above ECA spec (0.1 wt %), a retreatment reactor can be beneficial in reducing sulfur to the ECA-specified value or less.

The Retreatment Hydroprocessing Conditions (retreatment temperature $T_R$, total pressure $P_R$, and space velocity $WHSV_R$) can include $T_R$≥370° C.; e.g., in the range of from 350° C. to 450° C., or 370° C. to 415° C., or 375° C. to 425° C.; $WHSV_R$≤0.5 h$^{-1}$, e.g., in the range of from 0.2 h$^{-1}$ to 0.5 h$^{-1}$, or from 0.4 h$^{-1}$ to 0.7 h$^{-1}$; a molecular hydrogen supply rate ≥3000 scfb, e.g., in the range of from 3000 scfb (534 S m$^3$/m$^3$) to 6000 scfb (1068 S m$^3$/m$^3$); and/or $P_R$≥6 MPa, e.g., in the range of from 6 MPa to 13.1 MPa. Optionally, $T_R$>$T_I$ and/or $WHSV_R$<$WHSV_I$. Little or no fouling is typically observed in the retreatment reactor, mainly, it is believed, because the retreatment reactor's feed has been subjected to hydroprocessing in reactor 100. However, since most of the easy-to-remove sulfur is removed in the reactor 100, more severe run conditions can be utilized in the retreatment reactor 500 in order to meet a product sulfur spec of 0.1 wt %. When the hydroprocessed tar has a sulfur content ≥0.3 wt %, e.g., in the range of from 0.3 wt % to 0.8 wt %, or 0.5 wt %, these more severe conditions can include $T_R$ in the range of from 360° C. to 425° C., such as from 370° C. to 415° C.; $P_R$ in the range of from 1200 psi to 2000 psi, e.g., 1300 psi to 1500 psi; a treat gas rate in the range of from 3000 scfb to 5000 scfb (feed basis); and/or $WHSV_R$ in the range of from 0.2 $h^{-1}$ to 0.5 $h^{-1}$. Conventional catalysts can be used, but the present disclosure is not limited thereto, e.g., catalysts comprising one or more of Co, Mo, and Ni on a refractory support, e.g., alumina and/or silica.

The upgraded tar can have a sulfur content ≤0.3 wt %, e.g., ≤0.2 wt %. Other properties of the upgraded tar can include a hydrogen: carbon molar ratio ≥1.0, e.g., ≥1.05, such as ≥1.10, or ≥1.055; an $S_{BN}$≥185, such as ≥190, or ≥195; an $I_N$≤105, e.g., ≤100, such as ≤95; a 50° C. kinematic viscosity ≤1000 cSt, e.g., ≤900 cSt, such as ≤800 cSt; a 15° C. density ≤1.1 g/cm$^3$, e.g., ≤1.09 g/cm$^3$, such as ≤1.08 g/cm$^3$, or ≤1.07 g/cm$^3$; and/or a flash point ≥ or ≤−35° C. Generally, the retreating results in a significant improvement in one or more of viscosity, $S_{BN}$, $I_N$, and density over that of the hydroprocessed tar fed to the retreater. Desirably, since the retreating can be carried out without utility fluid, these benefits can be obtained without utility fluid hydrogenation or cracking. The upgraded tar can be blended with one or more blendstocks, e.g., to produce a lubricant or fuel, e.g., a transportation fuel. Suitable blendstocks include those specified for blending with the TLP and/or hydroprocessed tar.

EXAMPLES

Experiments were performed to test the level of fouling in liquid phase conditions (without $H_2$ co-feed) and in mixed phase (with $H_2$ co-feed) conditions. Various feed types were used and are shown in Table 1. A200 refers to Aromatic 200 Fluid available from ExxonMobil Chemical Company having an address at 4500 Bayway Drive, Baytown, Texas 77450, U.S.A., flux refers to a utility fluid consisting essentially of aromatic hydrocarbons which has 10% distillation point ≥60° C. and a 90% distillation point ≤425° C. as determined by ASTM D86.The unfluxed tar, Feeds 3 and 4, represents a tar that is fully heat soaked and without added flux. SCGO refers to steam cracker gas oil.

TABLE 1

| Example Feeds | |
|---|---|
| Feed 1 | Fluxed tar blend: 80% fluxed tar (52% tar and 28% flux) + 20% A200 |
| Feed 2 | Fluxed tar blend: 70% fluxed tar (52% tar and 18% flux) + 30% A200; with $H_2$ |
| Feed 3 | Unfluxed tar blend: 50% unfluxed tar + 50% A200; with $H_2$ |
| Feed 4 | Unfluxed tar blend: 70% unfluxed tar + 30% SCGO; with $H_2$ |

Figure 4:
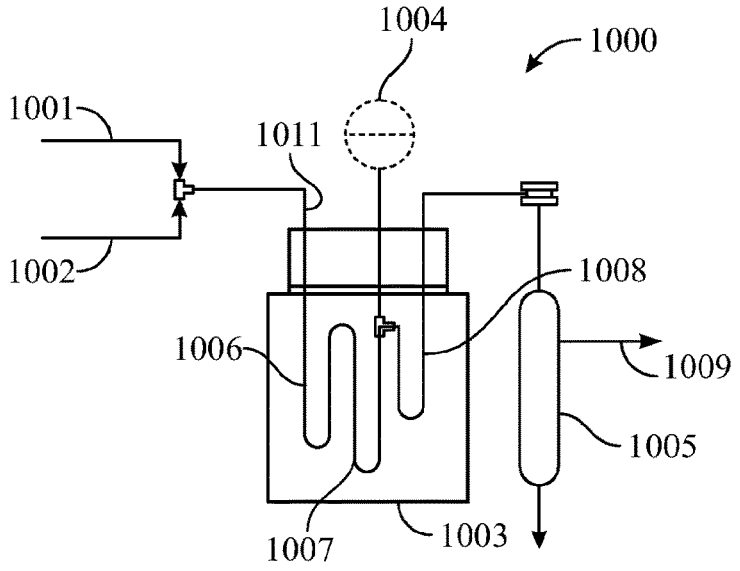
FIG. 4 schematically shows a pilot test unit ("PTU") utilized to carry out fouling experiments in the various Examples in this disclosure.

A batch pilot test unit ("PTU") setup 1000 shown in FIG. 4, designed to test fouling at high temperature and pressure conditions a tar feed in a preheater may be subjected to, was used to carry out the fouling experiments. The PTU coil 1011 was made of a type 316 stainless steel ¼", 0.049" OD tubing, the outside surface of which is heated by direct contact with hot sand in a fluidized sandbath 1003. As shown, the PTU coil 1011 is divided into three segments—1006, 1007, and 1008. The feed 1001 is optionally mixed with $H_2$ 1002 where applicable pursuant to Table 1. A thermocouple 1004 is located along the PTU coil 1011 for the purpose of measuring the temperature. After exiting the fluidized sandbath 1003, the feed enters a knockout pot/drum 1005 which serves to remove bulk liquids and particles from streams based on gravitational separation. A gas stream 1009 may exit the knockout pot/drum 1005.

Experimental Procedure. Flow rates, temperature and pressure conditions for the experiments were selected using AVEVA™ Pro/II™ simulations of planned operating conditions of commercial heat transfer equipment. The duration of each experiment was about 8 hours. The pressure range for the tests was about 875 psi to about 1000 psi gauge. The weight of the PTU coil 1011 by segment and in whole was measured before the start of each experiment. The fluidized sandbath 1003/PTU coil 1011 temperature was tested at about +50° F. to about +100° F. above 716° F. (380° C.) pre-heater outlet temperature to simulate the range of pre-heater "film" temperatures. The residence time range was about 90 seconds to about 380 seconds for liquid phase runs and about 20 seconds to about 40 seconds for mixed phase runs. Each feed was run for about 8 hours and then a shutdown procedure was started. During the shutdown procedure, the feed flow continued until the fluidized sandbath 1003 temperature dropped below about 500° F. to prevent coking inside the PTU coil 1011. After the temperature of the fluidized sandbath 1003 reached about room temperature, the PTU coil 1011 was flushed with toluene and purged using nitrogen to dry out any liquid left after the flush. The three coil segments—1006, 1007, and 1008—were then disconnected and weighed individually. The coke yield was calculated based on the weight difference in the PTU coil 1011 before and after the experiments. As shown below, coke lay-down in the PTU coil 1011 was also measured using metallography.

Figure 5:
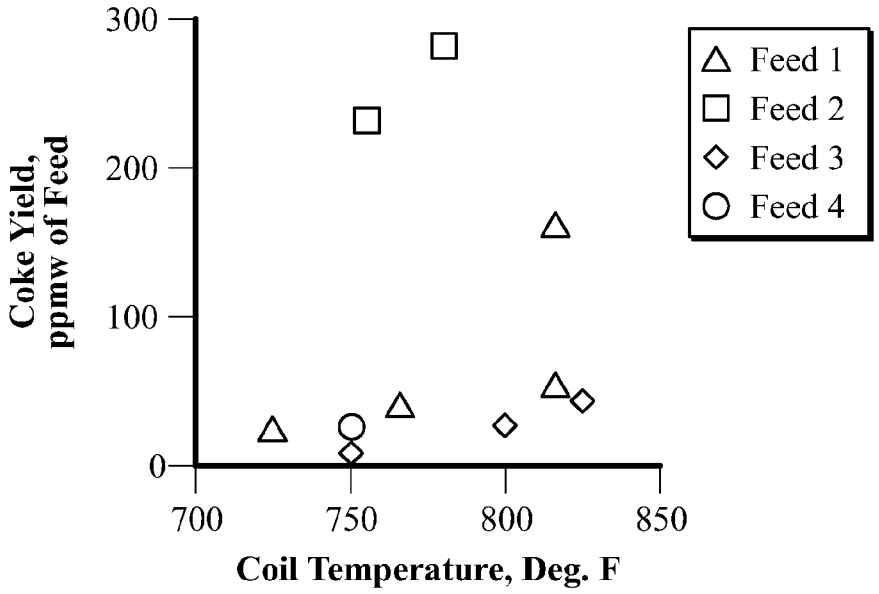
FIG. 5 is a diagram showing coke yield as a function of coil temperature in the fouling experiments in various Examples in this disclosure.

FIG. 5 shows the amount of coke yield (coke formation) as a function of PTU coil temperature in the fouling experiments. For the data in FIG. 5, the residence time was varied between about 180 seconds and about 400 seconds for liquid phase runs and between about 15seconds and about 40 seconds for mixed phase runs. The coke weight was estimated by normalizing for possible PTU coil weight loss during the experiments due to erosion. The data shows that coke yields were higher for fluxed tar runs with $H_2$ as a co-feed than for liquid phase runs. The fluxed tar with $H_2$ runs had the highest coke yield around 250-300 ppm, which may be due to the highly reactive nature of the flux, especially in the vapor phase. Coke yields were observed to be lowest in tests with the unfluxed tar even when the unfluxed tar was exposed to a co-feed of $H_2$ gas and at far higher temperatures than the fluxed tar tests. Although not wishing to be bound by theory, such results were attributed to the relative lack of reactive species in the unfluxed tar feed because the shut-down of the cold tar recycle caused heat soaking of the tar to saturate the reactive tar species. The coke yield was typically found to be highest in the first PTU coil segment—segment 1006 (the portion of the coil closest to the entry of the feed). This was hypothesized to be due to the oligomerization of the reactive olefins of the feed in that segment.

An experiment using Feed 4 (unfluxed tar+30% SCGO with $H_2$) was performed to assess the effect of flux (30% SCGO) on the unfluxed tar. The higher coke yield in this test compared to the unfluxed tar+$H_2$ with no flux indicates that the use of flux can be detrimental.

Figure 6:
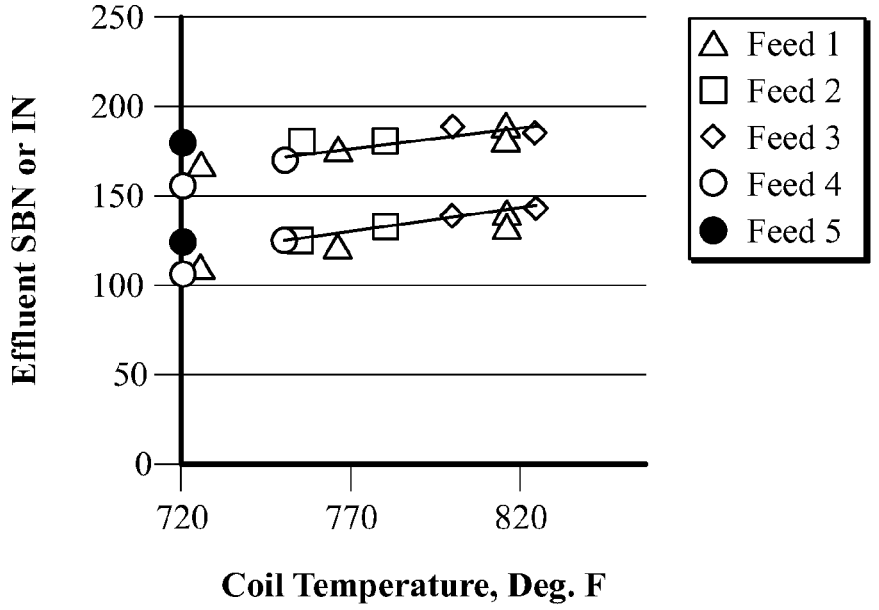
FIG. 6 is a diagram showing solubility blending number ($S_{BN}$) or insolubility number ($I_N$) of the various PTU effluent as a function of coil outlet temperature in various Examples in this disclosure.

The effect of pre-heater temperature on product compatibility parameters was also measured as shown in FIG. 6 and Table 2B. Table 2A shows the feeds tested and residence time conditions. Feeds 1-4 correspond to the example feeds of Table 1. Feed 5 is an unfluxed tar feed. FIG. 6 and Table 2B show a gradual increase in solubility blending number ($S_{BN}$) or insolubility number ($I_N$) of the PTU effluent as coil outlet temperature increases for a variety of feed and residence time conditions. Molecular hydrogen gas was co-fed for certain examples at about 3000 standard cubic feet per barrel (scfb) or about 1500 scfb. "Solubility blending number ($S_{BN}$)" and "insolubility number ($I_N$)" are described in U.S. Pat. No. 5,871,634,incorporated herein by reference in its entirety, and determined using n-heptane as the so-called "nonpolar, nonsolvent" and chlorobenzene as the solvent. The $S_{BN}$ and $I_N$ numbers are determined at a weight ratio of oil to test liquid mixture in the range of from 1 to 5.

TABLE 2A

Feed Type & Residence Time

| Feed Type | Residence Time (seconds, s) |
|---|---|
| Feed 1 | 180-368 |
| Feed 2 | 14-42 |
| Feed 3 | 15 |
| Feed 4 | 15 |
| Feed 5 | — |

TABLE 2B

Impact of Feed Type on the Feed and PTU Effluent Incompatibility at 400° C.

| Feed Type | Feed $S_{BN}$ | PTU effluent $S_{BN}$ | Feed $I_N$ | PTU effluent $I_N$ |
|---|---|---|---|---|
| Unfluxed tar w/3000 scfb $H_2$ | 180 | 170 | 125 | 125 |
| Fluxed tar w/3000 scfb $H_2$ | 172 | 167 | 119 | 123 |
| Fluxed tar w/1500 scfb $H_2$ | 172 | 176 | 119 | 122 |
| Fluxed tar (liquid phase) | 148 | 168 | 103 | 110 |

Metallograph measurements of the thickness of the coke layer were also performed for fouling characterization. Since the largest amount of coke was typically observed in the first segment of the PTU coil (segment 1006), this segment was cut at the top, center, and the bend locations for analyzing the coke thickness. The cut sections were analyzed radially using a metallograph. The maximum of these three coke thickness measurements was taken as the basis to estimate the time required to form a ¼ inch coke layer. For a defluxed tar feed with $H_2$, and conditions of 1450 psi and 750° F., the coke thickness of the top section, mid-section, and bend sections were measured at <0.001 inch, 0.0034 inch, and 0.0037 inch, respectively.

Figure 7:
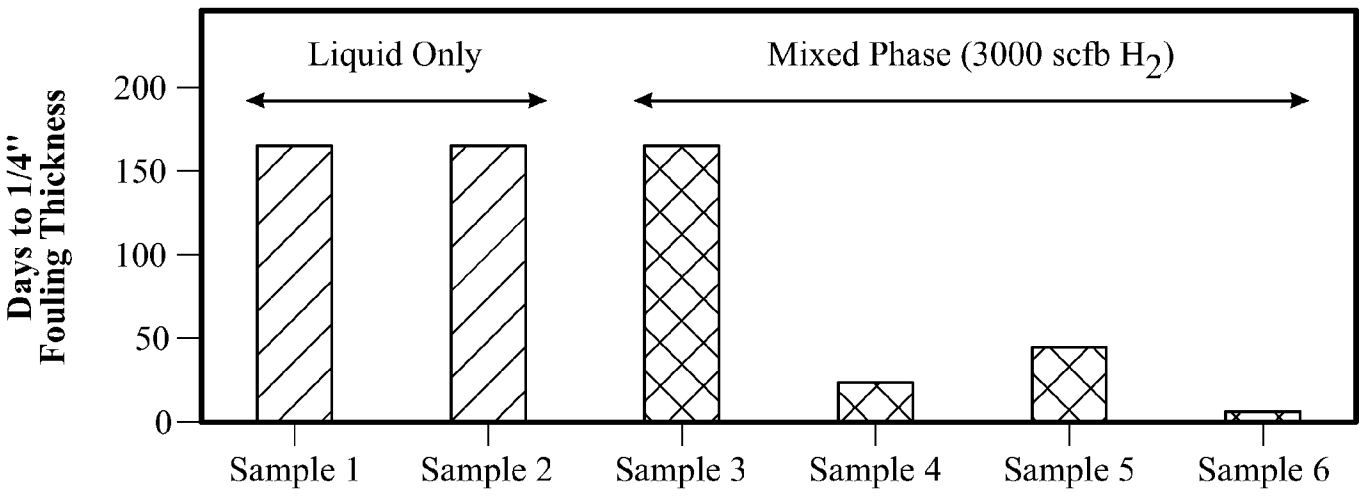
FIG. 7 is a diagram showing the fouling tendency of fluxed, defluxed, and unfluxed tar feeds in liquid phase and mixed phase as tested in various Examples in this disclosure.

FIG. 7 shows measured data for the fouling tendency of fluxed, defluxed, and unfluxed tar in liquid phase and mixed phase. Sample 1 is a fluxed tar that includes 52% tar and 28% flux. Sample 2 is a defluxed tar that includes only the tar portion. Sample 3 is an unfluxed tar which is fully heat soaked and without any flux. Sample 4 is a defluxed tar that includes only the tar portion. Sample 5 is a fluxed tar that includes 52% tar and 18% flux. Sample 6 is a fluxed tar that includes 52% tar and 18% flux. Samples 1 and 2 were not co-fed with molecular hydrogen gas (liquid phase); samples 3-6 were co-fed with molecular hydrogen gas (mixed phase). The remaining percentages in all of these samples were made up by A200to 100%.

Figure 8:
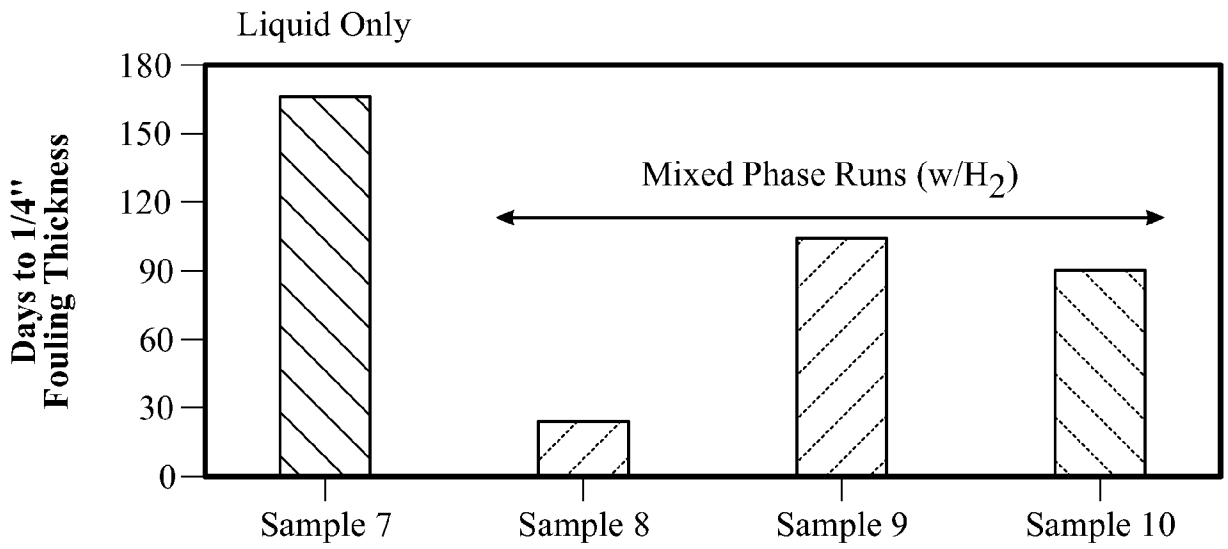
FIG. 8 is a diagram showing the fouling tendency of two fluxed tar feeds in liquid phase and mixed phase.

FIG. 8 shows measured data for four fluxed tar feeds run under liquid phase conditions and mixed phase conditions. Samples 7-10 were run at ~1400 psi pressure and ~400° C. (~752° F.), and the coke formation was measured using the metallograph technique discussed above. Table 3 shows various properties for the fluxed tar feeds shown in FIG. 8. For the mixed phase runs, sample 8 was run with ~3000 scfb $H_2$, sample 9 was run with ~1500 scfb $H_2$, and sample 10 was run with about 600 scfb $H_2$. Samples 7 and 8 utilized the same feed, one run under liquid phase conditions and the other run under mixed phase conditions. Samples 9 and 10 utilized the same feed, but run under different amounts of $H_2$ gas. $^1$H NMR refers to the hydrogen content of the feed as determined by $^1$H NMR.

TABLE 3

Feed Properties

| Feed | Density, g/cm$^3$ | Sulfur, wt % | $^1$H NMR, wt % | Olefins, wt % |
|---|---|---|---|---|
| Sample 7 | 1.076 | 2.26 | 7.82 | 0.09 |
| Sample 8 | 1.076 | 2.26 | 7.82 | 0.09 |
| Sample 9 | 1.08 | 2.93 | 7.08 | — |
| Sample 10 | 1.08 | 2.93 | 7.08 | — |

The estimates of different times to form a ~¼ inch coke layer thickness for fluxed tar feeds as shown by the data in FIGS. 7 and 8 may indicate that feed properties such as reactive species and particulates impact the potential for fouling. Table 4 shows the solids content analysis in the feed, the solids content in the PTU effluent after 8 hours, and the number of days to form a ¼ inch foulant layer for Samples 7-10 under liquid (without added $H_2$) or mixed phase conditions (with added $H_2$), ~1400 psi pressure, and ~400° C. (~752° F.).

TABLE 4

Solids Content in the Feed and PTU Effluent for Different Fluxed Tar Feeds

| Feed | Liquid or mixed phase | Feed, ppm | PTU effluent, ppm | Days to ¼ inch foulant layer |
|---|---|---|---|---|
| Sample 7 | Liquid phase | — | 330 | 180 |
| Sample 8 | Mixed phase | — | 90 | 24 |
| Sample 9 | Mixed phase | 54 | 52 | 105 |
| Sample 10 | Mixed phase | 54 | 52 | 90 |

The solids content of samples 7 and 8 were not measured but it can be estimated from the solids content of the PTU effluent in the liquid phase run. The solids content does not change significantly in the liquid phase runs, so the feed solids content was estimated to be about 350 ppm for Sample 7 & 8 feeds, much higher than the solids content of the sample 9and sample 10 feeds which was 90 ppm. Hence, the difference in estimated time to ¼" coke layer with different solids content suggests that the solids content in the feed can be important in determining the fouling potential.

Overall, the examples described herein demonstrated that heat-soaked tar had a relatively low tendency to foul the equipment, even at temperatures greater than 800° F. The examples also indicated that pre-heating of liquid phase tar and mixed phase tar reduces the reactivity of the feed entering the main hydroprocessing reactor, thereby lowering the amount of fouling and increasing the duration that the reactor can be run without fouling-related maintenance. The examples unequivocally indicated that reactive fouling can be mitigated pre-heating as described herein.

Embodiments described herein generally relate to methods for reducing fouling in tar upgrading processes and to apparatus for carrying out such processes. The embodiments enable equipment in the tar upgrading process to have a run-length longer than conventional apparatus without fouling-related maintenance stoppage when, e.g., the tar feed is heated either the liquid phase or the mixed phase.

Listing of Embodiments

Other non-limiting embodiments and/or aspects of the present disclosure can include:

A1. A method, comprising:

(I) providing a first tar stream;

(II) combining the first tar stream with a utility fluid to form a first process stream having a viscosity lower than that of the first tar stream; and (III) heating the first process stream in a pre-heater under liquid phase conditions without feeding molecular hydrogen gas into the pre-heater to form a second process stream exiting the pre-heater.

A2. The method of embodiment A1, further comprising:

(IV) feeding the second process stream into a hydroprocessing reactor; and (V) hydroprocessing the second process stream in the hydroprocessing reactor in the presence of a hydroprocessing catalyst under hydroprocessing conditions to produce a hydroprocessed effluent exiting the hydroprocessing reactor.

A3. The method of any one of embodiment A1 or A2, wherein the first tar stream has a bromine number of at least 20 as determined by ASTM D1159.

A4. The method of embodiment A3, wherein the bromine number of the first tar stream is at least 40 as determined by ASTM D1159.

A5. The method of any one of embodiments A1 to A4, wherein the first tar stream comprises at least one of: a steam cracker tar, a heavy coker gas oil, a vacuum tower fraction bottoms, a lube extract, a main column bottoms from fluid catalytic cracking, a steam cracker gas oil, a quench oil, and mixtures thereof.

A6. The method of any one of embodiments A1 to A5, wherein the first tar stream comprises a tar fraction and a steam cracker gas oil fraction and/or a quench oil fraction, and step (III) has at least one of the following features:

(a) an absolute pressure in the pre-heater in a range from 500 psia to 2000 psia (3,450 kPa to 13,790 kPa);

(b) a temperature of the second process stream in a range from 300° C. to 450° C.; and (c) a residence time of the first process stream in the pre-heater in a range from 10 seconds to 350 seconds.

A7. The method of any one of embodiments A1 to A6, wherein step (I) comprises:

(I-a) providing a fluxed tar stream comprising a tar fraction and a steam cracker gas oil fraction; and (I-b) removing at least a portion of the steam cracker gas oil fraction from the fluxed tar stream to produce the first tar stream, wherein the first tar stream has a normal boiling point of at least 300° C.

A8. The method of embodiment A7, further comprising:

(VI) separating a total liquids product from the hydroprocessed effluent;

(VII) separating the total liquids product to obtain a mid-cut fraction stream and a heavy bottoms fraction stream; and (VIII) providing at least a portion of the mid-cut fraction as at least a portion of the utility fluid in step (II).

A9. The method of any one of embodiments A1 to A8, further comprising removing solids, if any, from the first process stream prior to heating the first process stream.

A10. The method of any one of embodiments A1 to A9, wherein the pre-heater is operable for at least 100 days before an amount of foulant forms in a portion of the pre-heater, the amount of foulant in the portion of the pre-heater having a thickness of 0.25 inches or more.

B1. A method, comprising:

(i) providing a first tar stream;

(ii) heat soaking the first tar stream in a heat-soaking vessel to obtain a heat-soaked tar stream exiting the heat-soaking vessel;

(iii) combining the heat-soaked tar stream with a utility fluid to form a first process stream having a viscosity lower than that of the heat-soaked tar stream;

(iv) feeding the first process stream and optionally molecular hydrogen gas into a pre-heater; and (v) heating the first process stream in a pre-heater optionally in the presence of the molecular hydrogen gas to form a second process stream exiting the pre-heater.

B2. The method of embodiment B1, further comprising:

(vi) feeding the second process stream into a hydroprocessing reactor; and (vii) hydroprocessing the second process stream in the hydroprocessing reactor in the presence of a hydroprocessing catalyst under hydroprocessing conditions to produce a hydroprocessed effluent exiting the hydroprocessing reactor.

B3. The method of any one of embodiments B1 or B2, wherein the heat-soaked tar stream has a bromine number no greater than 35, as determined by ASTM D1159.

B4. The method of any one of embodiments B1 to B3, wherein the heat-soaked tar stream has a bromine number no greater than 28, as determined by ASTM D1159.

B5. The method of any one of embodiments B1 to B4, wherein step (ii) has at least one of the following features:

(a) an absolute pressure in the heat-soaking vessel in a range from 500 psia to 2000 psia (3,450 kPa to 13,790 kPa);

(b) a temperature of the heat-soaked tar stream in a range from 220° C. to 350° C.; or (c) a residence time of the first tar stream in the heat-soaking vessel in a range from 10minutes to 120 minutes.

B6. The method of any one of embodiments B1 to B5, wherein the first tar stream comprises at least one of: a steam cracker tar, a heavy coker gas oil, a vacuum tower fraction bottoms, a lube extract, a main column bottoms from fluid catalytic cracking, a steam cracker gas oil, a quench oil, and mixtures thereof.

B7. The method of any one of embodiments B1 to B6, wherein step (i) comprises:

(i-a) providing a fluxed tar stream comprising a tar fraction and a steam cracker gas oil fraction; and (i-b) removing at least a portion of the steam cracker gas oil fraction from the fluxed tar stream to produce the first tar stream, wherein the first tar stream has a normal boiling point of at least 300° C.

B8. The method of any one of embodiments B1 to B7, wherein in step (iv), the molecular hydrogen gas is fed into a pre-heater at a feeding rate in a range from 1 to 2000 standard cubic feet of molecular hydrogen gas per 42 US gallons of the heat-soaked tar stream.

B9. The method of any one of embodiments B1 to B8, wherein step (v) has at least one of the following features:

(a) an absolute pressure in the pre-heater in a range from 500 psia to 2000 psia (3,450 kPa to 13,790 kPa);

(b) a temperature of the second process stream in a range from 300° C. to 450° C.; and (c) a residence time of the first process stream in the pre-heater in a range from 10seconds to 350 seconds.

B10. The method of any one of embodiments B1 to B9, further comprising removing solids, if any, from the first process stream prior to heating the first process stream.

C1. An apparatus, comprising:

a pre-heater having a first end and a second end, the pre-heater configured to heat a tar stream in the absence of added molecular hydrogen gas;

a first conduit coupled to the first end of the pre-heater, the first conduit configured for flowing the tar stream therethrough;

a hydroprocessing reactor having a first end coupled to the second end of the pre-heater;

a fractionator having a first end coupled to a second end of the hydroprocessing reactor, the fractionator configured to separate a mid-cut solvent from a stream being fractionated; and a second conduit coupled to a second end of the fractionator, the second conduit configured for flowing the mid-cut solvent therethrough, the second conduit coupled to the first conduit.

In this disclosure, a process is described as comprising at least one "operation" or "step." It should be understood that each operation or step is an action that may be carried out once or multiple times in the process, in a continuous or discontinuous fashion. Unless specified to the contrary or the context clearly indicates otherwise, multiple operations or steps in a process may be conducted sequentially in the order as they are listed, with or without overlapping one or more other operations or steps, or in any other order, as the case may be. In addition, one or more or even all operations or steps may be conducted simultaneously with regard to the same or different batch of material. For example, in a continuous process, while a first operation or step in a process is being conducted with respect to a raw material just fed into the beginning of the process, a second operation or step may be carried out simultaneously with respect to an intermediate material resulting from treating the raw materials fed into the process at an earlier time in the first operation or step. In some embodiments, the operations or steps can be conducted in the order described.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

All documents described herein are incorporated by reference herein, including any priority documents and/or testing procedures to the extent they are not inconsistent with this text. As is apparent from the foregoing general description and the specific embodiments, while forms of this disclosure have been illustrated and described, various modifications can be made without departing from the spirit and scope of this disclosure. Accordingly, it is not intended that this disclosure be limited thereby. Likewise, the term "comprising" is considered synonymous with the term "including" for purposes of United States law. Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

While this disclosure has been described with respect to a number of embodiments and examples, those skilled in the art, having benefit of this disclosure, will appreciate that other embodiments can be devised which do not depart from the scope and spirit of this disclosure.

What is claimed is:

1. A method comprising:

(I) providing a first tar stream, wherein the first tar stream has a bromine number of at least 45 as determined by ASTM D1159;

(II) combining the first tar stream with a utility fluid to form a first process stream having a viscosity lower than that of the first tar stream; and (III) heating the first process stream in a pre-heater under liquid phase conditions without feeding molecular hydrogen gas into the pre-heater to form a second process stream exiting the pre-heater.

2. The method of claim 1, further comprising:

(IV) feeding the second process stream into a hydroprocessing reactor; and (V) hydroprocessing the second process stream in the hydroprocessing reactor in the presence of a hydroprocessing catalyst under hydroprocessing conditions to produce a hydroprocessed effluent exiting the hydroprocessing reactor.

3. The method of claim 1, wherein the bromine number of the first tar stream is at least 40 as determined by ASTM D1159.

4. The method of claim 1, wherein the first tar stream comprises at least one of: a steam cracker tar, a heavy coker gas oil, a vacuum tower fraction bottoms, a lube extract, a main column bottoms from fluid catalytic cracking, a steam cracker gas oil, a quench oil, and mixtures thereof.

5. The method of claim 1, wherein the first tar stream comprises a tar fraction and a steam cracker gas oil fraction and/or a quench oil fraction, and step (III) has at least one of the following features:

(a) an absolute pressure in the pre-heater in a range from 500 psia to 2000 psia (3,450 kPa to 13,790 kPa);

(b) a temperature of the second process stream in a range from 300° C. to 450° C.; and (c) a residence time of the first process stream in the pre-heater in a range from 10 seconds to 350 seconds.

6. The method of claim 1, wherein step (I) comprises:

(I-a) providing a fluxed tar stream comprising a tar fraction and a steam cracker gas oil fraction; and (I-b) removing at least a portion of the steam cracker gas oil fraction from the fluxed tar stream to produce the first tar stream, wherein the first tar stream has a normal boiling point of at least 300° C.

7. The method of claim 6, further comprising:

(VI) separating a total liquids product from the hydroprocessed effluent;

(VII) separating the total liquids product to obtain a mid-cut fraction stream and a heavy bottoms fraction stream; and (VIII) providing at least a portion of the mid-cut fraction as at least a portion of the utility fluid in step (II).

8. The method of claim 1, further comprising removing solids, if any, from the first process stream prior to heating the first process stream.

9. The method of claim 1, wherein the pre-heater is operable for at least 100 days before an amount of foulant forms in a portion of the pre-heater, the amount of foulant in the portion of the pre-heater having a thickness of 0.25 inches or more.

10. A method comprising:

(i) providing a first tar stream;

(ii) heat soaking the first tar stream in a heat-soaking vessel to obtain a heat-soaked tar stream exiting the heat-soaking vessel;

(iii) combining the heat-soaked tar stream with a utility fluid to form a first process stream having a viscosity lower than that of the heat-soaked tar stream;

(iv) feeding the first process stream and optionally molecular hydrogen gas into a pre-heater; and (v) heating the first process stream in a pre-heater optionally in the presence of the molecular hydrogen gas to form a second process stream exiting the pre-heater.

11. The method of claim 10, further comprising:

(vi) feeding the second process stream into a hydroprocessing reactor; and (vii) hydroprocessing the second process stream in the hydroprocessing reactor in the presence of a hydroprocessing catalyst under hydroprocessing conditions to produce a hydroprocessed effluent exiting the hydroprocessing reactor.

12. The method of claim 10, wherein the heat-soaked tar stream has a bromine number no greater than 35, as determined by ASTM D1159.

13. The method of claim 12, wherein the heat-soaked tar stream has a bromine number no greater than 28, as determined by ASTM D1159.

14. The method of claim 10, wherein step (ii) has at least one of the following features:

(a) an absolute pressure in the heat-soaking vessel in a range from 500 psia to 2000 psia (3,450 kPa to 13,790 kPa);

(b) a temperature of the heat-soaked tar stream in a range from 220° C. to 350° C.; or (c) a residence time of the first tar stream in the heat-soaking vessel in a range from 10 minutes to 120 minutes.

15. The method of claim 10, wherein the first tar stream comprises at least one of: a steam cracker tar, a heavy coker gas oil, a vacuum tower fraction bottoms, a lube extract, a main column bottoms from fluid catalytic cracking, a steam cracker gas oil, a quench oil, and mixtures thereof.

16. The method of claim 10, wherein step (i) comprises:

(i-a) providing a fluxed tar stream comprising a tar fraction and a steam cracker gas oil ("SCGO") fraction; and (i-b) removing at least a portion of the SCGO fraction from the fluxed tar stream to produce the first tar stream, wherein the first tar stream has a normal boiling point of at least 300° C.

17. The method of claim 10, wherein in step (iv), the molecular hydrogen gas is fed into a pre-heater at a feeding rate in a range from 1 to 2000 standard cubic feet of molecular hydrogen gas per 42 US gallons of the heat-soaked tar stream.

18. The method of claim 10, wherein step (v) has at least one of the following features:

(a) an absolute pressure in the pre-heater in a range from 500 psia to 2000 psia (3,450 kPa to 13,790 kPa);

(b) a temperature of the second process stream in a range from 300° C. to 450° C.; and (c) a residence time of the first process stream in the pre-heater in a range from 10 seconds to 350 seconds.

19. A method comprising:

(i) providing a fluxed tar stream comprising a tar fraction and a steam cracker gas oil ("SCGO") fraction;

(ii) removing at least a portion of the SCGO fraction from the fluxed tar stream to produce the first tar stream, wherein the first tar stream has a normal boiling point of at least 300C;

(iii) heat soaking the first tar stream in a heat-soaking vessel to obtain a heat-soaked tar stream exiting the heat-soaking vessel;

(iv) combining the heat-soaked tar stream with a utility fluid to form a first process stream having a viscosity lower than that of the heat-soaked tar stream;

(v) feeding the first process stream and optionally molecular hydrogen gas into a pre-heater; and (vi) heating the first process stream in a pre-heater optionally in the presence of the molecular hydrogen gas to form a second process stream exiting the pre-heater.

* * * * *